US010267115B2

(12) United States Patent
Hickie

(10) Patent No.: US 10,267,115 B2
(45) Date of Patent: Apr. 23, 2019

(54) WELLHEAD ISOLATION TOOL AND METHODS

(71) Applicant: OIL STATES ENERGY SERVICES, LLC, Houston, TX (US)

(72) Inventor: Barton Hickie, Oklahoma City, OK (US)

(73) Assignee: Oil States Energy Services, L.L.C., Houston, TX (US)

( * ) Notice: Subject to any disclaimer, the term of this patent is extended or adjusted under 35 U.S.C. 154(b) by 181 days.

(21) Appl. No.: 15/238,019

(22) Filed: Aug. 16, 2016

(65) Prior Publication Data

US 2017/0081935 A1 Mar. 23, 2017

Related U.S. Application Data

(63) Continuation of application No. 14/859,702, filed on Sep. 21, 2015, now Pat. No. 9,441,441.

(51) Int. Cl.

| | |
|---|---|
| ***E21B 33/04*** | (2006.01) |
| ***E21B 19/10*** | (2006.01) |
| ***E21B 33/068*** | (2006.01) |
| *E21B 43/26* | (2006.01) |

(52) U.S. Cl.

CPC ..... *E21B 33/04* (2013.01); *E21B 19/10* (2013.01); *E21B 33/068* (2013.01); *E21B 43/26* (2013.01)

(58) Field of Classification Search

CPC ..... E21B 33/04; E21B 33/068; E21B 19/10; E21B 43/26

See application file for complete search history.

(56) References Cited

U.S. PATENT DOCUMENTS

| | | | |
|---|---|---|---|
| 4,057,108 | A | 11/1977 | Broussard |
| 4,076,079 | A | 2/1978 | Herricks et al. |
| 4,632,183 | A | 12/1986 | McLeod |

(Continued)

FOREIGN PATENT DOCUMENTS

| | | |
|---|---|---|
| CA | 2195118 | 8/2000 |

OTHER PUBLICATIONS

Parker Hannifin Corporation—Composite Sealing Systems Division, "Metal Seal Design Guide," Jul. 2013, New Haven, Connecticut, 18 pages.

(Continued)

*Primary Examiner* — D. Andrews
*Assistant Examiner* — Yanick A Akaragwe
(74) *Attorney, Agent, or Firm* — Morgan, Lewis & Bockius LLP

(57) ABSTRACT

An isolation tool and related methods for protecting a wellhead to which a casing string is operably coupled. In an exemplary embodiment, the isolation tool includes an anchor assembly adapted to be connected to the wellhead; a mandrel adapted to sealingly engage an interior portion of at least one of the wellhead and the casing string; and a lock assembly including a mandrel head connected to the mandrel and adapted to be displaced, relative to the anchor assembly and the wellhead, to sealingly engage the mandrel with the interior portion; a landing sleeve connected to the mandrel head and adapted to be displaced, relative to the mandrel head, the mandrel, the anchor assembly, and the wellhead, to engage the anchor assembly; and a connector adapted to secure the landing sleeve to the anchor assembly when the mandrel sealingly engages the interior portion and the landing sleeve engages the anchor assembly.

27 Claims, 14 Drawing Sheets

(56) References Cited

U.S. PATENT DOCUMENTS

| | | | |
|---|---|---|---|
| 4,993,488 | A | 2/1991 | McLeod |
| 5,819,851 | A | 10/1998 | Dallas |
| 6,179,053 | B1 | 1/2001 | Dallas |
| 6,289,993 | B1 | 9/2001 | Dallas |
| 6,364,024 | B1 | 4/2002 | Dallas |
| 6,626,245 | B1 | 9/2003 | Dallas |
| 6,817,423 | B2 | 11/2004 | Dallas |
| 7,032,677 | B2 | 4/2006 | McGuire et al. |
| 7,040,410 | B2 | 5/2006 | McGuire et al. |
| 7,066,269 | B2 | 6/2006 | Dallas et al. |
| 7,308,934 | B2 | 12/2007 | Swagerty et al. |
| 7,484,776 | B2 | 2/2009 | Dallas et al. |
| 7,490,666 | B2 | 2/2009 | Swagerty et al. |
| 7,614,448 | B2 | 11/2009 | Swagerty et al. |
| 7,900,697 | B2 | 3/2011 | Swagerty et al. |
| 8,302,678 | B2 | 11/2012 | Swagerty et al. |
| 2011/0198844 | A1 | 8/2011 | Weinhold |
| 2011/0266006 | A1 | 11/2011 | Lacheny et al. |
| 2015/0096738 | A1 | 4/2015 | Atencio |
| 2015/0292661 | A1 | 10/2015 | Gilbreath |

OTHER PUBLICATIONS

Office Action dated Jan. 29, 2016 in U.S. Appl. No. 14/859,665, USPTO, 19 pages.

Notice of Allowance dated Apr. 22, 2016 in U.S. Appl. No. 14/859,665, USPTO, 5 pages.

Office Action dated Jan. 21, 2016 in U.S. Appl. No. 14/859,702, USPTO, 8 pages.

Office Action dated Apr. 14, 2016 in U.S. Appl. No. 14/859,702, USPTO, 7 pages.

Notice of Allowance dated Jun. 10, 2016 in U.S. Appl. No. 14/859,702, USPTO, 5 pages.

WELLHEAD ISOLATION TOOL AND METHODS

CROSS-REFERENCE TO RELATED APPLICATIONS

This application is a continuation of U.S. application Ser. No. 14/859,702, entitled WELLSITE CONNECTOR APPARATUS AND METHOD and filed on Sep. 21, 2015, the entire disclosure of which is hereby incorporated herein by reference.

This application is related to U.S. application Ser. No. 14/859,665, entitled WELLHEAD ISOLATION TOOL AND METHODS and filed on Sep. 21, 2015, now U.S. Pat. No. 9,366,103, the entire disclosure of which is hereby incorporated herein by reference.

TECHNICAL FIELD

The present disclosure relates generally to oil or gas wellbore equipment, and, more particularly, to a wellhead isolation tool and wellsite connectors for same.

BACKGROUND

Wellhead equipment utilized in connection with an oil or gas wellbore may be subject to extreme conditions during oilfield operations, such as, for example, cementing, acidizing, fracturing, and/or gravel packing of a subterranean wellbore. Wellhead isolation tools are often used to protect wellhead equipment from excessive pressures, temperatures, and flow rates encountered during such oilfield operations. An exemplary wellhead isolation tool is adapted to position and secure a mandrel within a wellhead. The mandrel includes a packoff assembly, which is adapted to isolate the wellhead equipment from fluid flowing through the mandrel to and from the oil or gas wellbore. However, in the field, the performance and reliability of the mandrel and packoff assembly are often an issue because of the extreme duty cycles experienced by wellhead isolation tools during oilfield operations. For example, during oil or gas wellbore fracturing operations, wellhead equipment may be subject to a fluid or slurry pressure of up to 20,000 psi or more. As a result, the high pressures and flow rates encountered during oil or gas wellbore fracturing operations often cause packoff assemblies to "lift-off" from a sealing surface, allowing the fracturing fluid or slurry to leak or blow by the packoff assembly and into the wellhead equipment. Moreover, in order to protect the packoff assembly from damage, it is important to provide support against external forces applied to the mandrel along the longitudinal axis thereof, in both axial directions. Therefore, what is needed is an apparatus, system, or method that addresses one or more of the foregoing issues, among one or more other issues.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements.

DETAILED DESCRIPTION

Figure 1:
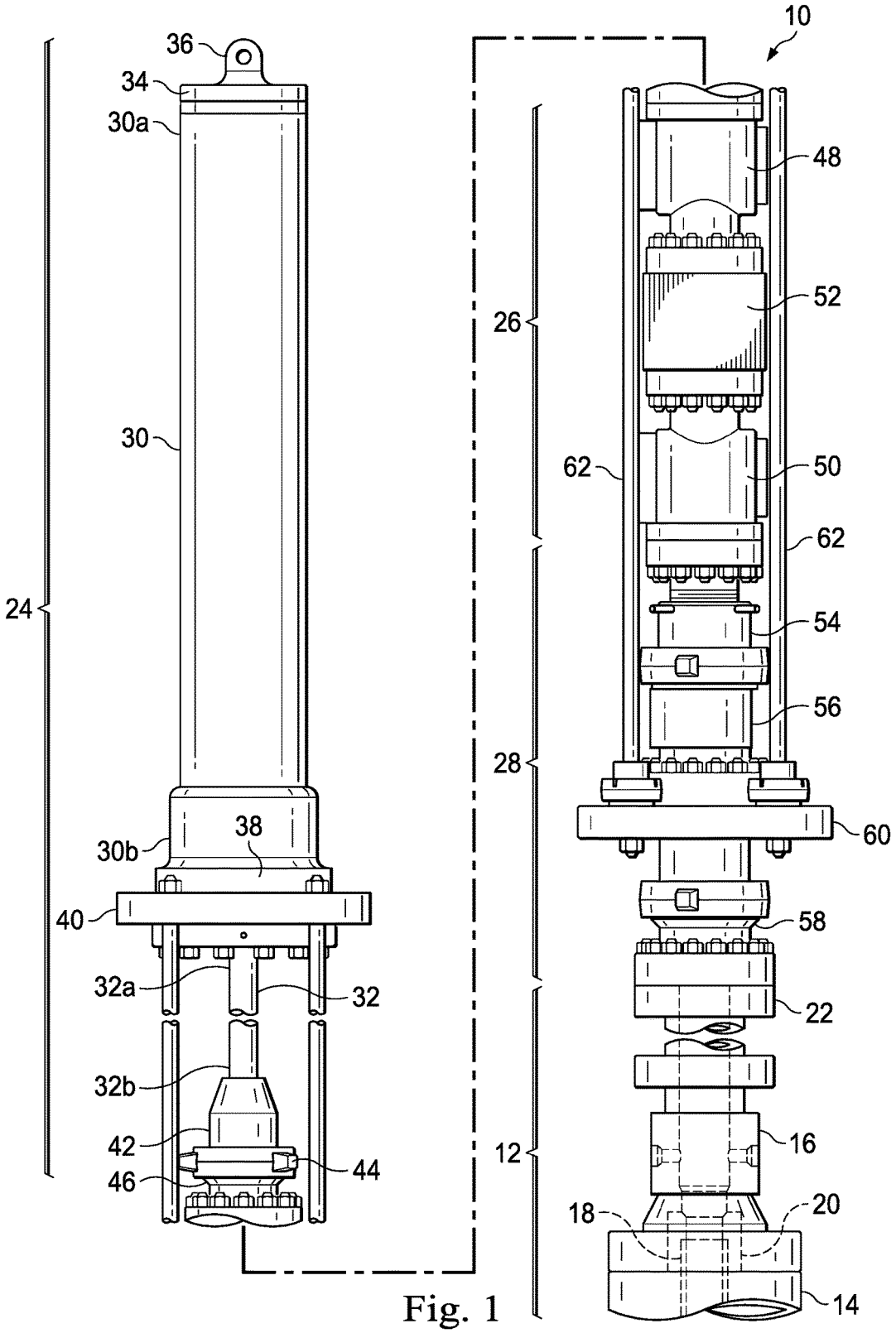
FIG. 1 is a diagrammatic view of a wellhead isolation assembly, including a hydraulic cylinder, a valve stack, and a wellhead isolation tool, according to an exemplary embodiment.

In an exemplary embodiment, as illustrated in FIG. 1, a wellhead isolation assembly is schematically illustrated and generally designated by the reference numeral 10. The wellhead isolation assembly 10 is adapted to be connected to a wellhead 12, which is, includes, or is part of, one or more wellhead components, such as, for example, a casing head 14 and a tubing spool 16. In several exemplary embodiments, the tubing spool 16 is adapted to receive a casing string 18, which may include a bit guide 20. Instead of, or in addition to, the casing head 14 and the tubing spool 16, the wellhead 12 is, includes, or is part of, one or more other wellhead components, such as, for example, a casing spool, a casing hanger, a tubing head, a tubing hanger, a packoff seal, a valve tree, a blowout preventer, an isolation valve, choke equipment, another wellhead component, or any combination thereof. An uppermost flange 22 extends from the wellhead 12.

Still referring to FIG. 1, the wellhead isolation assembly 10 includes an actuator, such as, for example, a hydraulic cylinder 24. The wellhead isolation assembly 10 also includes a valve stack 26 and a wellhead isolation tool 28. The hydraulic cylinder 24 includes a cylinder barrel 30 and a piston rod 32, which extends within the cylinder barrel 30. The cylinder barrel 30 defines opposing end portions 30*a* and 30*b*. The end portion 30*a* of the cylinder barrel 30 is sealed off by a cylinder cap 34, which includes a hook connector 36. The end portion 30*b* of the cylinder barrel 30 includes a cylinder head 38, through which the piston rod 32 extends. Furthermore, a support plate 40 is connected to the cylinder barrel 30 at the end portion 30*b*, and extends radially outward therefrom.

The piston rod 32 defines opposing end portions 32*a* and 32*b*. The end portion 32*a* of the piston rod 32 is connected to a piston (not shown) disposed within the cylinder barrel 30. The piston (not shown) is adapted to reciprocate back and forth within the cylinder barrel 30, thereby causing the piston rod 32 to reciprocate back and forth through the cylinder head 38. The end portion 32*b* of the piston rod 32 includes a plug 42 and a connector, such as, for example, a threaded wing nut 44. The threaded wing nut 44 is adapted to connect the plug 42 to the valve stack 26 by threadably engaging an adapter 46, which is connected to the valve stack 26. Thus, when the threaded wing nut 44 is connected to the adapter 46, as shown in FIG. 1, the plug 42 prevents the flow of a fluid upwardly through the valve stack 26.

The valve stack 26 includes one or more valves such as, for example, a pair of valves 48 and 50, which are adapted to either prevent or allow the flow of a fluid through the valve stack 26. The valve stack 26 may also include a fluid block 52 connected between the valves 48 and 50, respectively. The fluid block 52 includes an internal passage (not shown), through which a fluid is communicated between the valves 48 and 50, respectively. The fluid block 52 may also include one or more diverter passages (not shown), through which a fluid is communicated to and/or from the internal passage of the fluid block 52. The valve stack 26 is connected to the wellhead isolation tool 28. In several exemplary embodiments, instead of, or in addition to, the valves 48 and 50, the valve stack 26 includes one or more other valves.

The wellhead isolation tool 28 includes a lock assembly 54, an anchor assembly 56, and an adapter 58. The lock assembly 54 is adapted to be connected to the anchor assembly 56, as shown in FIG. 1. The anchor assembly 56 includes a base plate 60 that extends radially outward therefrom. Moreover, as shown in FIG. 1, the anchor assembly 56 is adapted to be connected to the adapter 58, which, in turn, is connected to the uppermost flange 22 of the wellhead 12. In several exemplary embodiments, the adapter 58 is part of the anchor assembly 56. In several exemplary embodiments, the adapter 58 is part of the wellhead 12. A plurality of stay rods 62 are connected between the base plate 60 of the anchor assembly 56 and the support plate 40 of the hydraulic cylinder 24. The stay rods 62 secure the support plate 40 in position relative to the base plate 60, thereby enabling the hydraulic cylinder 24 to urge the valves 48 and 50, the fluid block 52, and the lock assembly 54 downwardly toward the anchor assembly 56, as will be discussed in further detail below.

Figure 2:
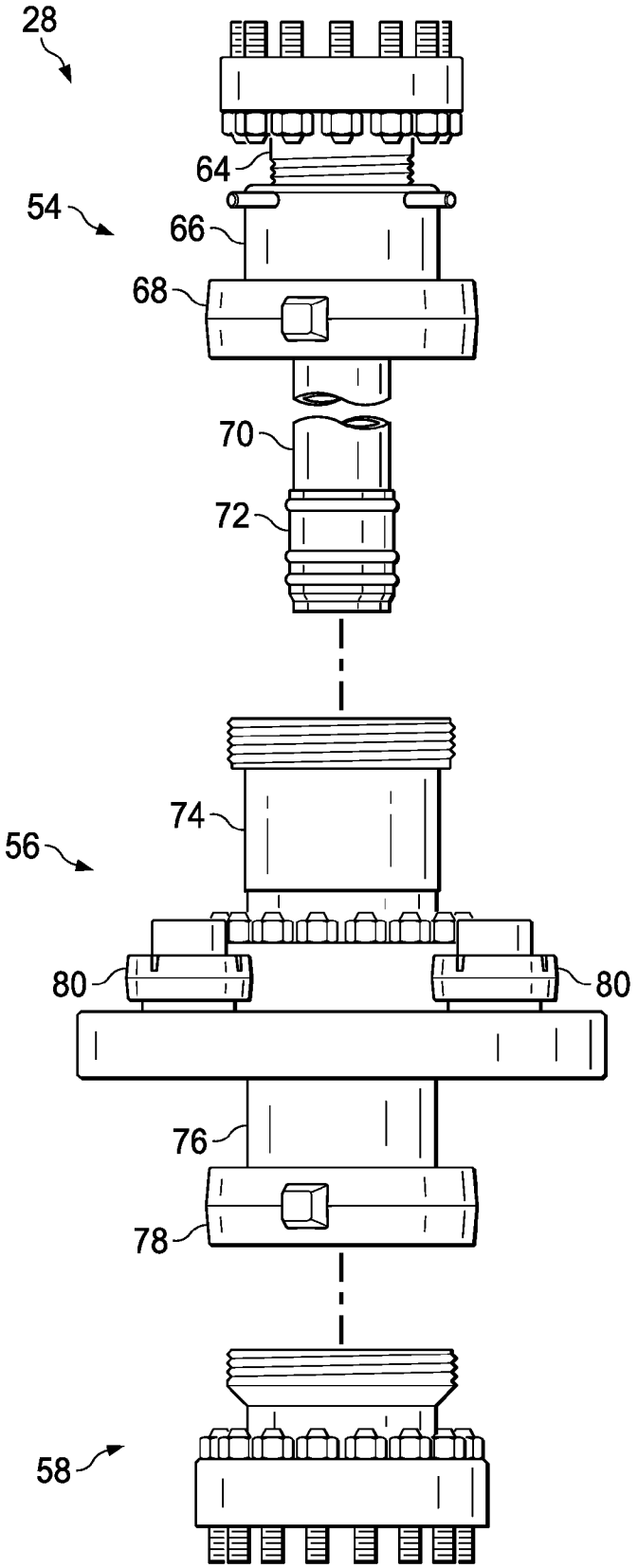
FIG. 2 is an exploded diagrammatic view of the wellhead isolation tool of FIG. 1, including a lock assembly, an anchor assembly, and an adapter, according to an exemplary embodiment.

Referring to FIG. 2, the wellhead isolation tool 28, including the lock assembly 54, the anchor assembly 56, and the adapter 58, is shown in a disassembled state.

In an exemplary embodiment, as shown in FIG. 2, the lock assembly 54 includes a mandrel head 64, a landing sleeve 66, and a connector, such as, for example, a threaded wing nut 68. The lock assembly 54 is adapted to secure a mandrel 70 in sealing engagement with at least one of the wellhead 12 and the casing string 18, as will be discussed in further detail below. In several exemplary embodiments, the mandrel 70 is part of the lock assembly 54. The landing sleeve 66 is threadably engaged with the mandrel head 64. Further, the landing sleeve 66 retains the threaded wing nut 68. The mandrel head 64 supports a mandrel 70, to which a packoff assembly 72 is connected. In several exemplary embodiments, the packoff assembly 72 is part of the mandrel 70. The mandrel 70 is adapted to extend through the anchor assembly 56 and the adapter 58, and into the wellhead 12. As a result, the packoff assembly 72 is adapted to sealingly engage a portion of at least one of the wellhead 12 and the casing string 18, as will be discussed in further detail below.

In an exemplary embodiment, with continuing reference to FIG. 2, the anchor assembly 56 includes a support member 74, a base member 76, and a connector, such as, for example, a threaded wing nut 78. The base plate 60 is connected to the base member 76 and extends radially outward therefrom. Further, the base plate 60 includes a plurality of stay rod connectors 80, to which the stay rods 62 are adapted to be connected. The support member 74 is also connected to the base member 76 via a flanged connection with the base plate 60. The support member 74 is adapted to be engaged by, and threadably connected to, the threaded wing nut 68 of the lock assembly 54. The base member 76 retains the threaded wing nut 78 for engagement with the adapter 58. The adapter 58 is adapted to be connected to the uppermost flange 22 of the wellhead 12. The adapter 58 is thus adapted to be engaged by, and threadably connected to, the threaded wing nut 78.

Figure 3:
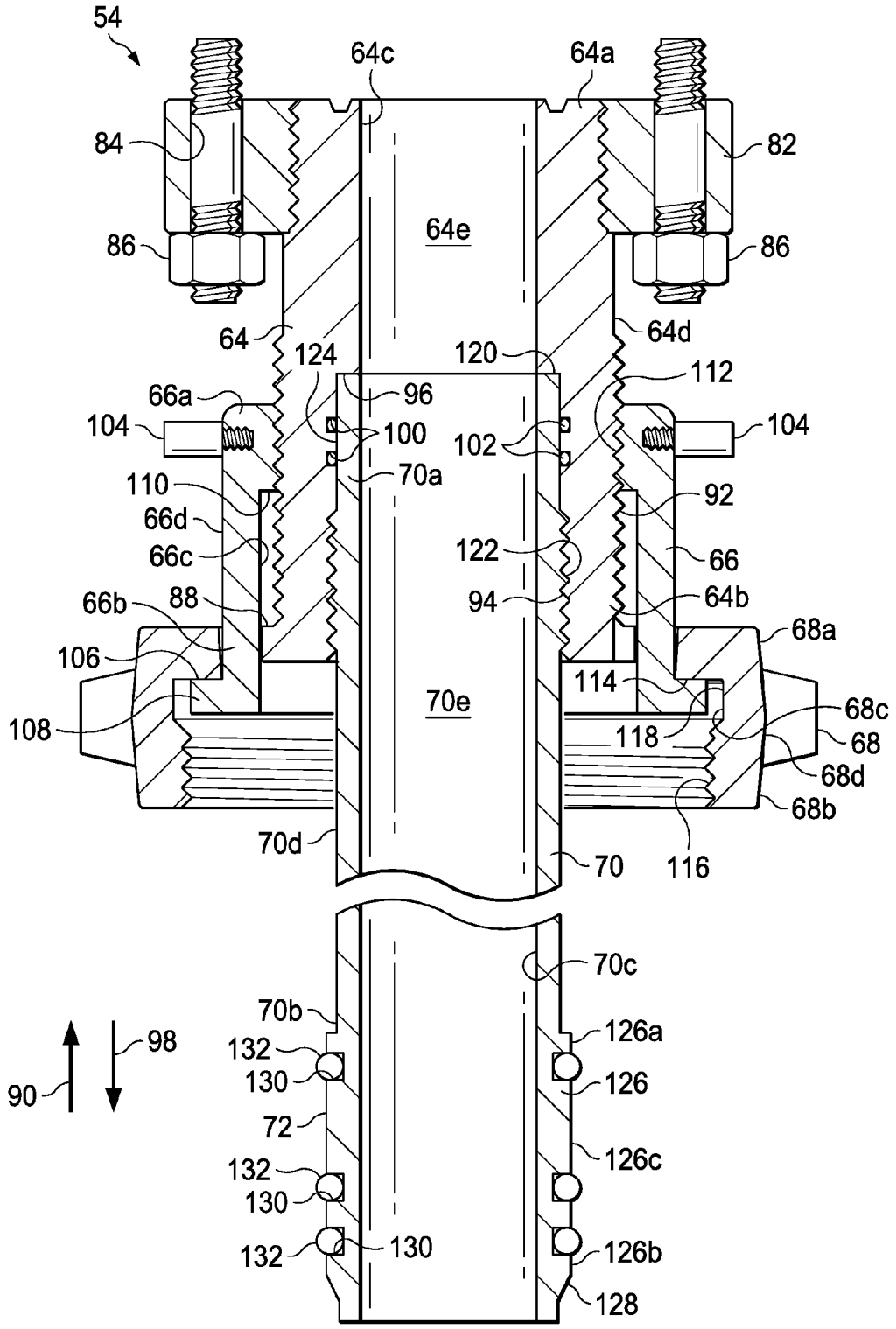
FIG. 3 is a cross-sectional view of the lock assembly of FIG. 2, including a mandrel head, a landing sleeve, a threaded wing nut, and a mandrel, according to an exemplary embodiment.

Referring now to FIG. 3, an exemplary embodiment of the lock assembly 54 of the wellhead isolation tool 28 is illustrated, including the mandrel head 64, the landing sleeve 66, and the threaded wing nut 68.

In an exemplary embodiment, as shown in FIG. 3, the mandrel head 64 defines opposing end portions 64*a* and 64*b*, an interior portion 64*c*, and an exterior portion 64*d*. The mandrel head 64 further defines an internal passage 64*e* circumscribed by the interior portion 64*c* thereof. A flange 82 is connected to the end portion 64*a* of the mandrel head 64, and extends radially outward from the exterior portion 64*d* thereof. In several exemplary embodiments, the flange 82 is threadably connected to the end portion 64*a* of the mandrel head 64. The flange 82 includes a plurality of through-holes 84 formed therethrough. The through-holes 84 accommodate a plurality of fasteners 86, which are adapted to connect the flange 82 and, consequently, the mandrel head 64 to the valve 50. An external annular shoulder 88 is formed into the exterior portion 64*d* of the mandrel head 64 at the end portion 64*b* thereof. The external annular shoulder 88 faces in an axial direction 90. The mandrel head 64 includes external threads 92 located proximate the end portion 64*b* thereof, adjacent the external annular shoulder 88. Further, the mandrel head 64 includes internal threads 94 located at the end portion 64*b* thereof. An internal annular shoulder 96 is formed into the interior portion 64*c* of the mandrel head 64. The internal annular shoulder 96 faces in an axial direction 98, which is substantially opposite the axial direction 90. A pair of annular grooves 100 are formed into the interior portion 64*c* of the mandrel head 64, between the internal threads 94 and the internal annular shoulder 96. The annular grooves 100 each accommodate an annular seal 102.

In an exemplary embodiment, with continuing reference to FIG. 3, the landing sleeve 66 defines opposing end portions 66*a* and 66*b*, an interior portion 66*c*, and an exterior portion 66*d*. A plurality of handles 104 are connected to, and extend radially outward from, the exterior portion 66*d* of the landing sleeve 66 at the end portion 66*a* thereof. The handles 104 are distributed circumferentially about the landing sleeve 66. An external annular shoulder 106 is formed into the exterior portion 66*c* of the landing sleeve 66 proximate the end portion 66*b* thereof. The external annular shoulder 106 faces in the axial direction 90. As a result, an external annular foot 108 is formed at the end portion 66*b* of the landing sleeve 66. An internal annular shoulder 110 is formed into the interior portion 66*c* of the landing sleeve 66 proximate the end portion 66*a* thereof. The internal annular shoulder 110 faces in the axial direction 98. The landing sleeve 66 includes internal threads 112 located at the end portion 66*a* thereof, adjacent the internal annular shoulder 110. The internal threads 112 of the landing sleeve 66 engage the external threads 92 of the mandrel head 64. The landing sleeve 66 is adapted to be displaced relative to the mandrel head 64 in either the axial direction 90 or the axial direction 98, via the threaded engagement of the internal threads 112 of the landing sleeve 66 with the external threads 92 of the mandrel head 64. Such axial displacement is accomplished by rotating the landing sleeve 66 relative to the mandrel head 64, via the plurality of handles 104. In this manner, the landing sleeve 66 is adapted to be advanced in the axial direction 98 until the internal annular shoulder 110 of the landing sleeve 66 abuts the external annular shoulder 88 of the mandrel head 64.

In an exemplary embodiment, with continuing reference to FIG. 3, the threaded wing nut 68 defines opposing end portions 68*a* and 68*b*, an interior portion 68*c* and an exterior portion 68*d*. An internal annular shoulder 114 is formed into the interior portion 68*c* of the threaded wing nut 68 at the end portion 68*a* thereof. The internal annular shoulder 114 faces in the axial direction 98. The threaded wing nut 68 includes internal threads 116 located proximate the end portion 68*b* thereof. An internal annular recess 118 is formed in the interior portion 68*c* of the threaded wing nut 68, between the internal annular shoulder 114 and the internal threads 116. The internal annular recess 118 is adapted to accommodate a portion of the external annular foot 108 of the landing sleeve 66. Further, the threaded wing nut 68 is permitted to rotate, and slide axially, in relation to the landing sleeve 66, thus permitting the internal annular shoulder 114 of the threaded wing nut 68 to abut the external annular shoulder 106 of the landing sleeve 66.

In an exemplary embodiment, with continuing reference to FIG. 3, the mandrel 70 defines opposing end portions 70*a* and 70*b*, an interior portion 70*c*, and an exterior portion 70*d*. The mandrel 70 further defines an internal passage 70*e* circumscribed by the interior portion 70*c* thereof. The mandrel 70 includes an end face 120 at the end portion 70*a* thereof. The end face 120 faces in the axial direction 90 and abuts the internal annular shoulder 96 of the mandrel head 64. The mandrel 70 includes external threads 122 located proximate the end portion 70*a* thereof. The external threads 122 of the mandrel 70 engage the internal threads 94 of the mandrel head 64, thereby connecting the mandrel 70 to the mandrel head 64. The exterior portion 70*d* of the mandrel 70 further defines an annular sealing surface 124 at the end portion 70*a* thereof, between the end face 120 and the external threads 122. Alternatively, in several exemplary embodiments, the interior portion 64*c* of the mandrel head 64 defines the annular sealing surface 124 and the annular grooves 100 are formed into the exterior portion 70*c* of the mandrel 70. In any event, the annular sealing surface 124 is sealingly engaged by the annular seals 102 accommodated within the annular grooves 100. In this manner, the annular seals 102 are adapted to seal a flow of fluid within the internal passages 64*e* and 70*e*, respectively, of the mandrel head 64 and the mandrel 70. The packoff assembly 72 is connected to the exterior portion 70*d* of the mandrel 70 at the end portion 70*b* thereof. In several exemplary embodiments, the packoff assembly 72 in integrally formed with the mandrel 70. The packoff assembly 72 includes an annular body 126 defining opposing end portions 126*a* and 126*b*, and an exterior portion 126*c*. The exterior portion 126*c* of the annular body 126 includes an external annular shoulder 128 at the end portion 126*b* thereof. The external annular shoulder 128 faces generally in the axial direction 98. In several exemplary embodiments, the external annular shoulder 128 is tapered. A plurality of annular grooves 130 are formed in the exterior portion 126*c* of the annular body 126, and are axially spaced between the end portions 126*a* and 126*b* thereof. Annular seals 132 are accommodated within respective ones of the annular grooves 130.

Figure 4:
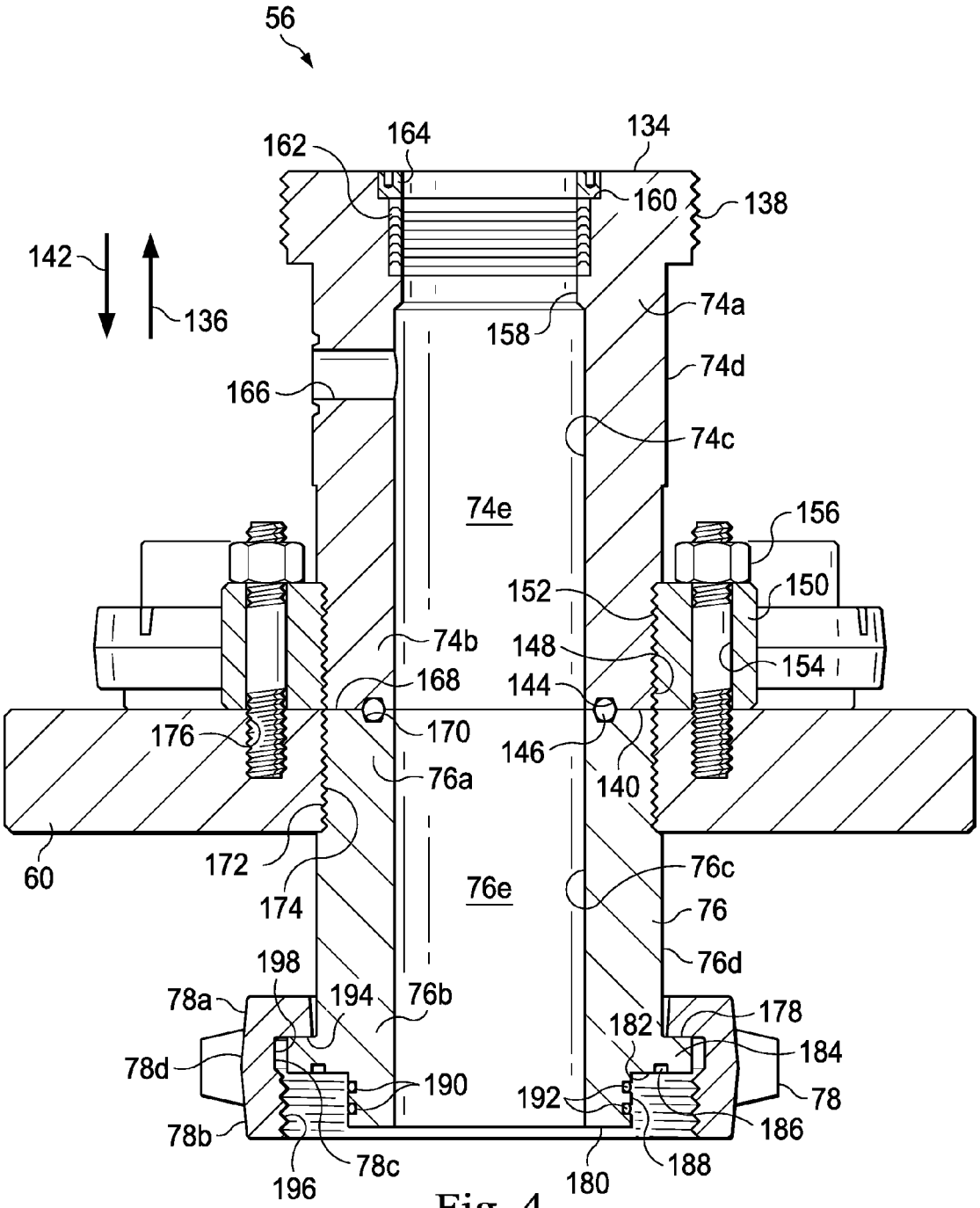
FIG. 4 is a cross-sectional view of the anchor assembly of FIG. 2, including a support member, a base member, and a threaded wing nut, according to an exemplary embodiment.

Referring now to FIG. 4, an exemplary embodiment of the anchor assembly 56 of the wellhead isolation tool 28 is illustrated, including the support member 74, the base member 76, and the threaded wing nut 78.

In an exemplary embodiment, as shown in FIG. 4, the support member 74 defines opposing end portions 74*a* and 74*b*, an interior portion 74*c*, and an exterior portion 74*d*. The support member 74 further defines an internal passage 74*e* circumscribed by the interior portion 74*c* thereof. The support member 74 includes an end face 134 at the end portion 74*a* thereof. The end face 134 faces in an axial direction 136. The support member 74 includes external threads 138 at the end portion 74*a* thereof. The external threads 138 of the support member 74 are adapted to be engaged by, and connected to, the internal threads 116 of the threaded wing nut 68 of the lock assembly 54. The support member 74 includes an end face 140 at the end portion 74*b* thereof. The end face 140 faces in an axial direction 142, which is substantially opposite the axial direction 136. An axially-facing annular groove 144 is formed into the end face 140 of the support member 74. The annular groove 144 accommodates a seal 146, such as, for example, a gasket.

The support member 74 also includes external threads 148 at the end portion 74*b* thereof. A flange 150 is connected to the end portion 74*b* of the support member 74, via the external threads 148. Specifically, the flange 150 includes internal threads 152, which are threadably engaged with the external threads 148 of the support member 74. The flange 150 also includes a plurality of through-holes 154 formed therethrough. The through-holes 154 are adapted to accommodate a plurality of fasteners 156. In several exemplary embodiments, the threaded engagement of the internal threads 152 with the external threads 148 enables the connection of the flange 150 to the support member 74 without the use of metal-joining techniques, such as, for example, welding, brazing, or soldering. Thus, the connection of the flange 150 to the support member 74 is a weld-less connection. However, in other embodiments, the connection of the flange 150 to the support member 74 is facilitated, at least in part, by a metal-joining technique, such as, for example, welding, brazing, or soldering.

An internal annular ridge 158 is formed into the interior portion 74*c* of the support member 74, proximate the end portion 74*a* thereof. Further, an internal annular shoulder 160 is formed into the interior portion 74*c* of the support member 74, between the internal annular ridge 158 and the end face 134. The internal annular shoulder 160 faces in the axial direction 136. An internal annular seal, such as, for example, a plurality of self-energizing annular seals 162, is disposed along the interior portion 74*c* of the support member 74, between the internal annular shoulder 160 and the internal annular ridge 158. The self-energizing annular seals 162 may include any type of self-energizing seals, such as, for example, O-rings, chevron seals (V-packing), another type of self-energizing seals, or any combination thereof. Further, a packing nut 164 is engaged with the internal annular shoulder 160. The packing nut 164 applies a load, in the axial direction 142, against the self-energizing annular seals 162 and, consequently, the internal annular ridge 158. As a result, the self-energizing annular seals 162 are trapped between the packing nut 164 and the internal annular ridge 158. Thus trapped, the self-energizing annular seals 162 are adapted to sealingly engage the exterior portion 70*d* of the mandrel 70 when the mandrel 70 extends through the support member 74. Moreover, once the packing nut 164 is in place, the self-energizing annular seals 162 are adapted to remain in a fixed position relative to the anchor assembly 56, including the support member 74 and the base member 76, during operation of the lock assembly 54.

The support member 74 may also include a radially-extending opening 166 formed therethrough, from the interior portion 74*c* to the exterior portion 74*d* thereof. The radially-extending opening 166 is used to place the support member 74 in fluid communication with, for example, a variety of bleed-off equipment (not shown).

In an exemplary embodiment, with continuing reference to FIG. 4, the base member 76 defines opposing end portions 76*a* and 76*b*, an interior portion 76*c*, and an exterior portion 76*d*. The base member 76 further defines an internal passage 76*e* circumscribed by the interior portion 76*c* thereof. The base member 76 includes an end face 168 at the end portion 76*a* thereof. The end face 168 faces in the axial direction 136. An axially-facing annular groove 170 is formed into the end face 168 of the base member 76. The annular groove 170 accommodates the seal 146. Thus, the seal 146 is disposed within the respective annular grooves 144 and 170 of the support member 74 and the base member 76. In this position, the seal 146 is adapted to seal a flow of fluid within the respective internal passages 74*e* and 76*e* of the support member 74 and the base member 76.

The base member 76 includes external threads 172 at the end portion 76*a* thereof. The base plate 60 is connected to the end portion 76*a* of the base member 76, via the external threads 172. Specifically, the base plate 60 includes internal threads 174, which are threadably engaged with the external threads 172 of the base member 76. In several exemplary embodiments, the threaded engagement of the internal threads 174 with the external threads 172 enables the connection of the base plate 60 to the base member 76 without the use of metal-joining techniques, such as, for example, welding, brazing, or soldering. Thus, the connection of the base plate 60 to the base member 76 is a weld-less connection. However, in other embodiments, the connection of the base plate 60 to the base member 76 is facilitated, at least in part, by a metal-joining technique, such as, for example, welding, brazing, or soldering. The base plate 60 also includes a plurality of threaded-holes 176, which are threadably engaged by the plurality of fasteners 156. Alternatively, in some embodiments, the threaded-holes 176 are formed into the flange 150 and the through-holes 154 are formed into the base plate 60. In other embodiments, the base plate 60 and the flange 150 both include threaded-holes. In still other embodiments, the flange 150 includes the through-holes 154 and the base plate 60 also includes through-holes. In any event, the fasteners 156 connect the flange 150 to the base plate 60 and, consequently, the base member 76. The connection between the base plate 60 and the flange 150 enables the connection of the support member 74 to the base member 76 without the use of metal-joining techniques, such as, for example, welding, brazing, or soldering. Thus, the connection between the base plate 60 and the flange 150 is a weld-less connection. However, in other embodiments, the connection between the base plate 60 and the flange 150 is facilitated, at least in part, by a metal-joining technique, such as, for example, welding, brazing, or soldering.

An external annular shoulder 178 is formed into the exterior portion 76*d* of the base member 76 proximate the end portion 76*b* thereof. The external annular shoulder 178 faces in the axial direction 136. The base member 76 includes an end face 180 at the end portion 76*b* thereof. The end face 180 faces in the axial direction 142. An external annular shoulder 182 is also formed into the exterior portion 76*d* of the base member 76 proximate the end portion 76*b* thereof, and is located axially between the external annular shoulder 178 and the end face 180. The external annular shoulder 182 faces in the axial direction 142. As a result, an external annular foot 184 is formed at the end portion 76*b* of the base member 76. An annular groove 186 is formed into the external annular shoulder 182. The base member 76 includes an axially-extending annular portion 188 at the end portion 76*b* thereof, extending between the external annular shoulder 182 and the end face 180. One or more annular grooves 190 are formed into the annular portion 188 of the base member 76. The annular grooves 190 are each adapted to accommodate an annular seal 192.

In an exemplary embodiment, with continuing reference to FIG. 4, the threaded wing nut 78 defines opposing end portions 78*a* and 78*b*, an interior portion 78*c* and an exterior portion 78*d*. An internal annular shoulder 194 is formed into the interior portion 78*c* of the threaded wing nut 78 at the end portion 78*a* thereof. The internal annular shoulder 194 faces in the axial direction 142. The threaded wing nut 78 includes internal threads 196 located proximate the end portion 78*b* thereof. An internal annular recess 198 is formed into the interior portion 78*c* of the threaded wing nut 78, between the internal annular shoulder 194 and the internal threads 196. The internal annular recess 198 is adapted to accommodate a portion of the external annular foot 184 of the base member 76. Further, the threaded wing nut 78 is permitted to rotate, and slide axially, in relation to the base member 76, thus permitting the internal annular shoulder 194 of the threaded wing nut 78 to abut the external annular shoulder 178 of the base member 76.

Figure 5:
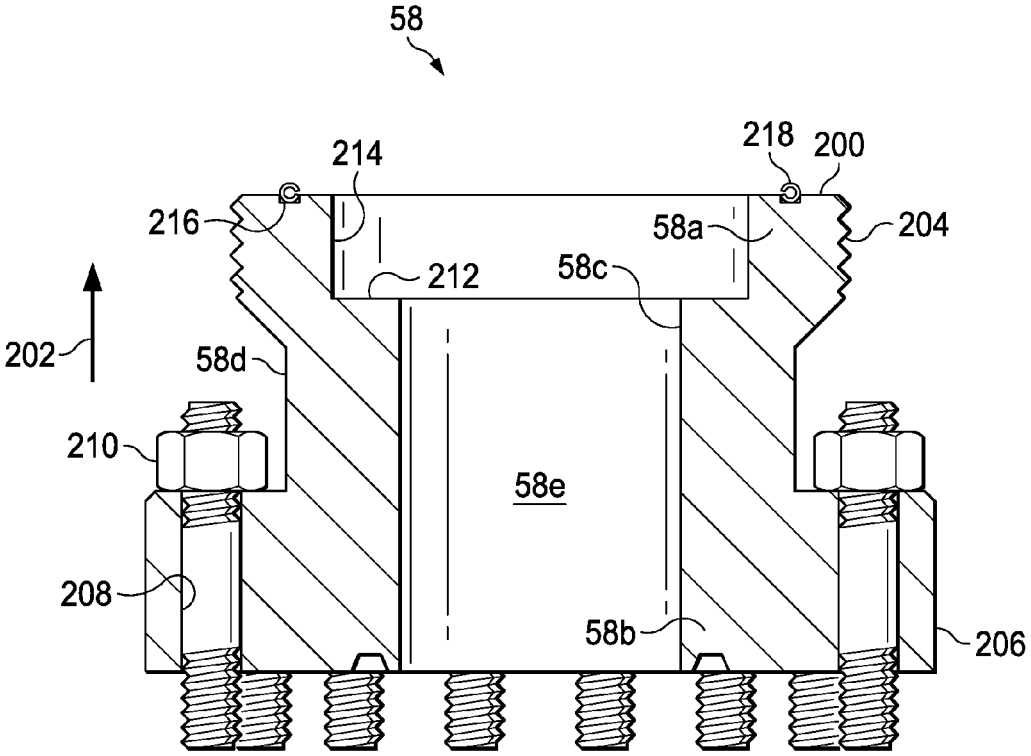
FIG. 5 is a cross-sectional view of the adapter of FIG. 2, according to an exemplary embodiment.

Referring now to FIG. 5, an exemplary embodiment of the adapter 58 of the wellhead isolation tool 28 is illustrated. The adapter 58 defines opposing end portions 58*a* and 58*b*, an interior portion 58*c*, and an exterior portion 58*d*. The adapter 58 further defines an internal passage 58*e* circumscribed by the interior portion 58*c* thereof. The adapter 58 includes an end face 200 at the end portion 58*a* thereof. The end face 200 faces in an axial direction 202. The adapter 58 includes external threads 204 at the end portion 58*a* thereof. The external threads 204 of the adapter 58 are adapted to be engaged by, and connected to, the internal threads 196 of the threaded wing nut 78. A flange 206 is connected to the end portion 58*b* of the adapter 58, and extends radially outward from the exterior portion 58*d* thereof. The flange 206 includes a plurality of through-holes 208 formed therethrough. The through-holes 208 accommodate a plurality of fasteners 210, which are adapted to connect the flange 206 and, consequently, the adapter 58 to the uppermost flange 22 of the wellhead 12.

An internal annular shoulder 212 is formed into the interior portion 58*c* of the adapter 58 at the end portion 58*a* thereof. The internal annular shoulder 212 faces in the axial direction 202. The adapter 58 includes an axially-extending annular portion 214 at the end portion 58*a* thereof, extending between the internal annular shoulder 212 and the end face 200. The annular portion 214 is adapted to be sealingly engaged by the annular seals 192, which are accommodated within the annular grooves 190 in the annular portion 188 of the base member 76. Alternatively, in several exemplary embodiments, the annular grooves 190 is formed into the annular portion 214 of the adapter 58 and the annular seals 192 are adapted to sealingly engage the annular portion 188 of the base member 76. An annular groove 216 is formed into the end face 200 of the adapter 58. The annular groove 216 accommodates a resilient metal seal 218, such as, for example, a metal C-ring seal. The resilient metal seal 218 is adapted to be crushed between the annular groove 216 in the end face 200 of the adapter 58 and the annular groove 186 in the external annular shoulder 182 of the base member 76. In this manner, when the base member 76 is connected to the adapter 58, the resilient metal seal 218, along with the annular seals 192, is adapted to seal a flow of fluid within the respective internal passages 58*e* and 76*e* of the adapter 58 and the base member 76.

In operation, in an exemplary embodiment, as illustrated in FIGS. 6A-6D, 7, 8 and 9A-9C, the wellhead isolation tool 28 is used to fluidically isolate at least a portion of the wellhead 12 from the casing string 18.

Figure 6A:
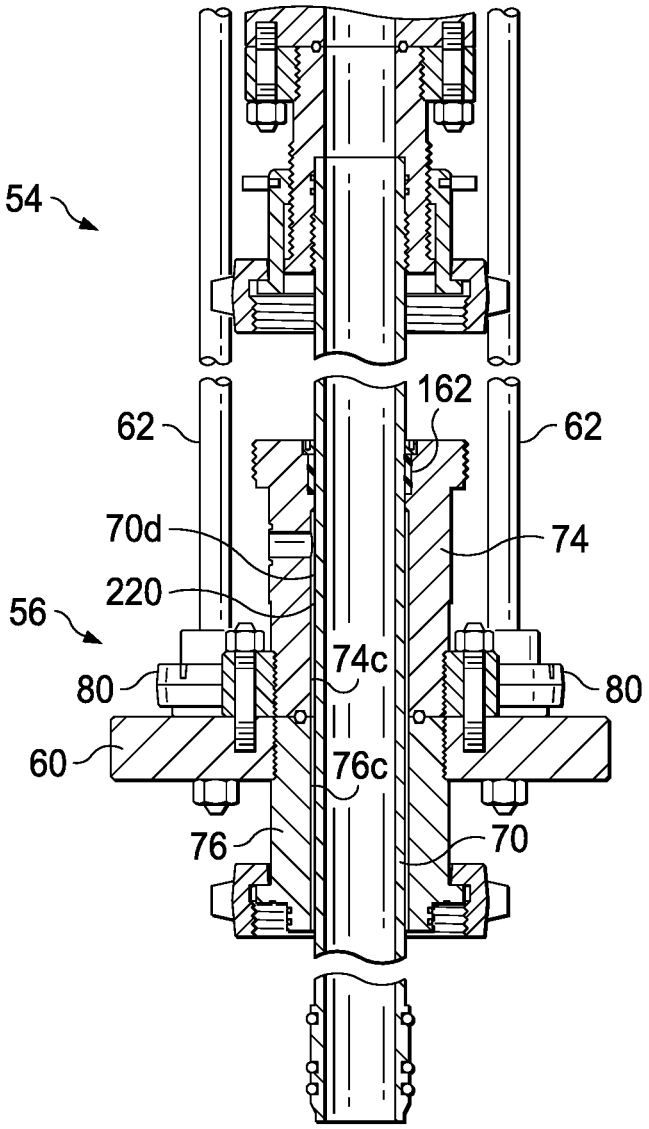
FIG. 6A is cross-sectional view of a portion of the wellhead isolation tool of FIGS. 1-5, the lock assembly of FIG. 3 being assembled, via a plurality of stay rods, with the anchor assembly of FIG. 4, according to an exemplary embodiment.

Referring initially to FIG. 6A, the anchor assembly 56 is initially assembled with the lock assembly 54, the valve stack 26 (visible in FIG. 1), and the hydraulic cylinder 24 (visible in FIG. 1), such that the mandrel 70 extends through the respective internal passages 74*e* and 76*e* of the support member 74 and the base member 76. An annular space 220 is thus defined between the exterior portion 70*d* of the mandrel 70 and the respective interior portions 74*c* and 76*c* of the support member 74 and the base member 76. Further, the exterior portion 70*d* of the mandrel 70 is sealingly, and slidingly, engaged by the self-energizing annular seals 162 of the support member 74. As mentioned above, the packing nut 164 retains the self-energizing annular seals 162 in a fixed position relative to the anchor assembly 56, including the support member 74 and the base member 76, during operation of the lock assembly 54. The stay rods 62 are connected between the support plate 40 of the hydraulic cylinder 24 (visible in FIG. 1) and the stay rod connectors 80 of the base plate 60. The stay rods 62 secure the support plate 40 in relation to the base plate 60, thereby enabling the hydraulic cylinder 24 to axially displace the valve stack 26 and the lock assembly 54 in relation to the anchor assembly 56.

Figure 6B:
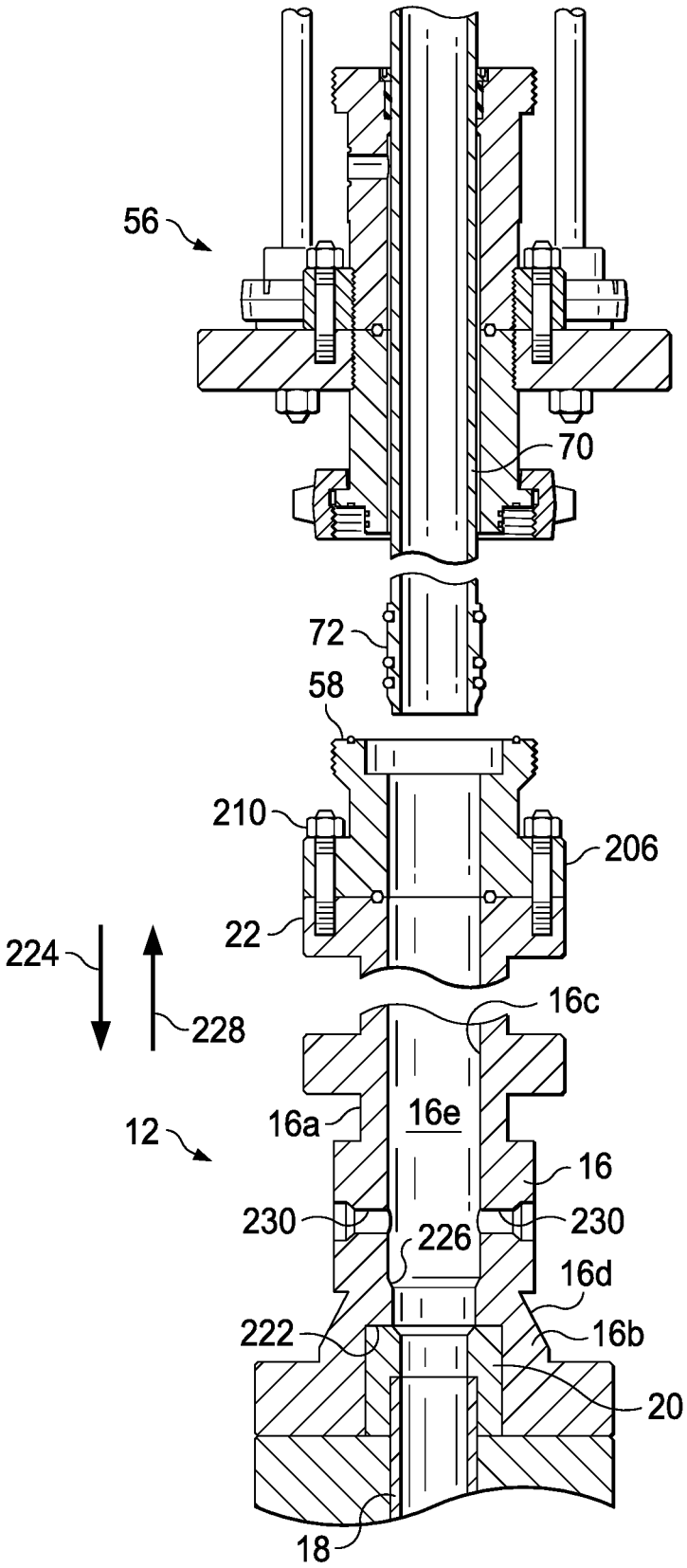
FIG. 6B is a cross-sectional view of the wellhead isolation tool of FIGS. 1-5 and 6A, as the lock assembly, anchor assembly, and stay rods of FIG. 6A are suspended above a wellhead, to which the adapter of FIG. 5 is connected, according to an exemplary embodiment.

Referring now to FIG. 6B, the adapter 58 is shown connected to the uppermost flange 22 of the wellhead 12 via the flange 206 and the fasteners 210. Regarding the structure of the wellhead 12, in an exemplary embodiment, the tubing spool 16 of the wellhead 12 defines opposing end portions 16*a* and 16*b*, an interior portion 16*c*, and an exterior portion 16*d*. The tubing spool 16 further defines an internal passage 16*e* circumscribed by the interior portion 16*c* thereof. An internal annular shoulder 222 is formed into the interior portion 16*c* of the tubing spool 16. The internal annular shoulder 222 faces in an axial direction 224. At least one of the bit guide 20 and the casing string 18 abuts, or nearly abuts, the internal annular shoulder 222 of the tubing spool 16. An internal annular shoulder 226 may also be formed into the interior portion 16*c* of the tubing spool 16. The internal annular shoulder 226 is located above the internal annular shoulder 222 and faces in an axial direction 228, which is substantially opposite the axial direction 224. The tubing spool 16 may also include radially-extending ports 230 formed therethrough, from the interior portion 16*c* to the exterior portion 16*d* thereof. The radially-extending ports 230 are used to place the internal passage 16*e* of the tubing spool 16 in fluid communication with a variety of well-site equipment (not shown).

Still referring to FIG. 6B with added reference to FIG. 1, the hydraulic cylinder 24, the valve stack 26, the lock assembly 54, and the anchor assembly 56, which are secured relative to one another via the stay rods 62 (as discussed above in relation to FIG. 6A), are suspended, via the hook connector 36 of the hydraulic cylinder 24, over the adapter 58 and, consequently, the wellhead 12. From this position, the mandrel 70 and the packoff assembly 72 are ready to be lowered in the axial direction 224, through the adapter 58, into the wellhead 12, and, consequently, into the internal passage 16*e* of the tubing spool 16.

Figure 6C:
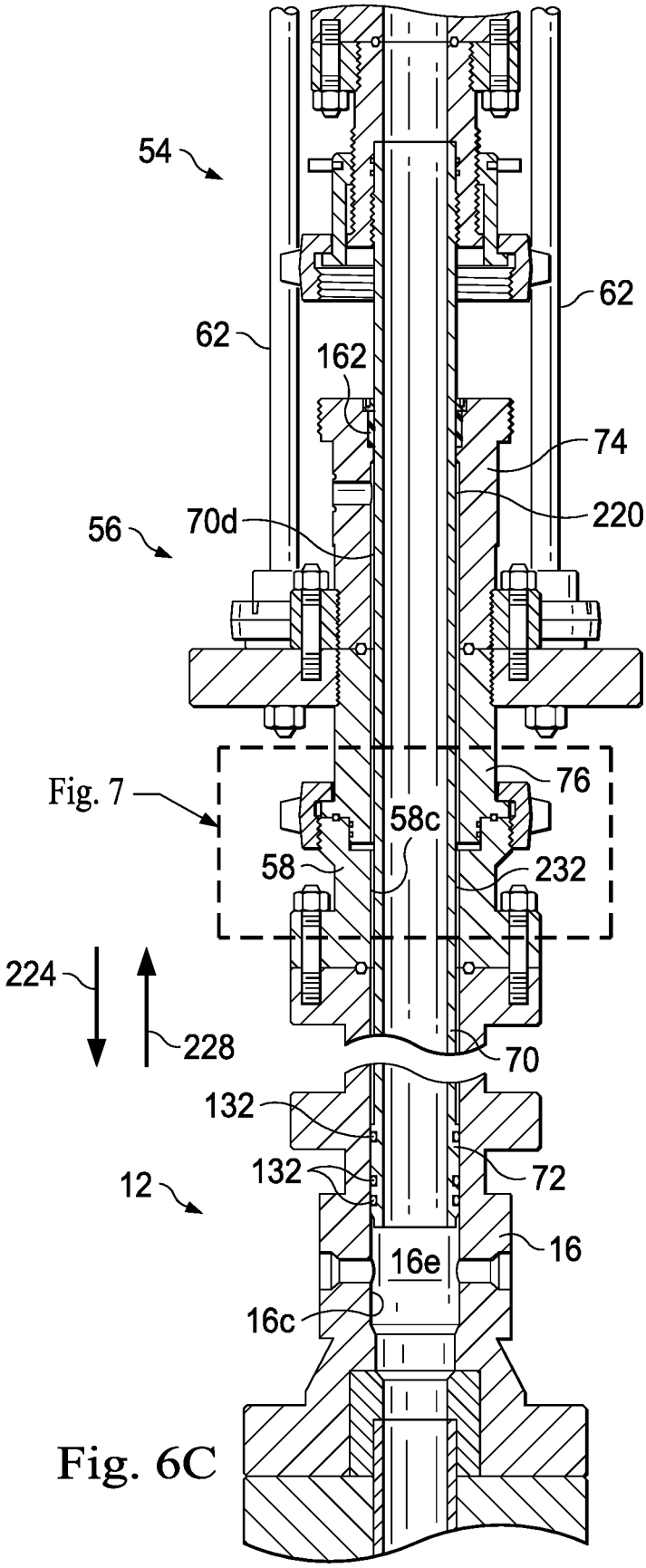
FIG. 6C is a cross-sectional view of the wellhead isolation tool of FIGS. 1-5 and 6A-6B, as the lock assembly, anchor assembly, and stay rods of FIG. 6A are lowered in relation to the adapter and wellhead of FIG. 6B, according to an exemplary embodiment.

Referring additionally to FIG. 6C, the hydraulic cylinder 24, the valve stack 26, the lock assembly 54, and the anchor assembly 56, which are secured relative to one another via the stay rods 62 (as discussed above in relation to FIG. 6A) and suspended via the hook connector 36 of the hydraulic cylinder 24 (as discussed above in relation to FIG. 6B), are lowered in the axial direction 224 relative to the wellhead 12. As a result, the mandrel 70 and the packoff assembly 72 are inserted through the adapter 58, into the wellhead 12 and, consequently, into the internal passage 16*e* of the tubing spool 16. With the mandrel 70 positioned as such, the self-energizing annular seals 162 of the support member 74 sealingly engage the exterior portion 70*d* of the mandrel 70. Further, the interior portion 16*c* of the tubing spool 16 is engaged by the annular seals 132 of the packoff assembly 72. Alternatively, in several exemplary embodiments, the annular seals 132 of the packoff assembly 72 are adapted to engage an interior portion of the casing string 18. An annular space 232 is defined between the exterior portion 70*d* of the mandrel 70 and the interior portion 58*c* of the adapter 58. As the mandrel 70 is lowered in relation to the wellhead 12, the annular space 232 extends to include additional annular space defined between the exterior portion 70*d* of the mandrel 70 and various components of the wellhead 12, such as, for example, the uppermost flange 22, the tubing spool 16, etc. Moreover, the annular space 232 is in fluid communication with the annular space 220. Accordingly, as the mandrel 70 is lowered, the self-energizing annular seals 162 of the support member 74 prevent, or at least obstruct, a flow of fluid through the respective annular spaces 220 and 232 from escaping to the atmosphere. At the same time, the self-energizing annular seals 162 remain in a fixed position relative to the anchor assembly 56, including the support member 74 and the base member 76.

Figure 7:
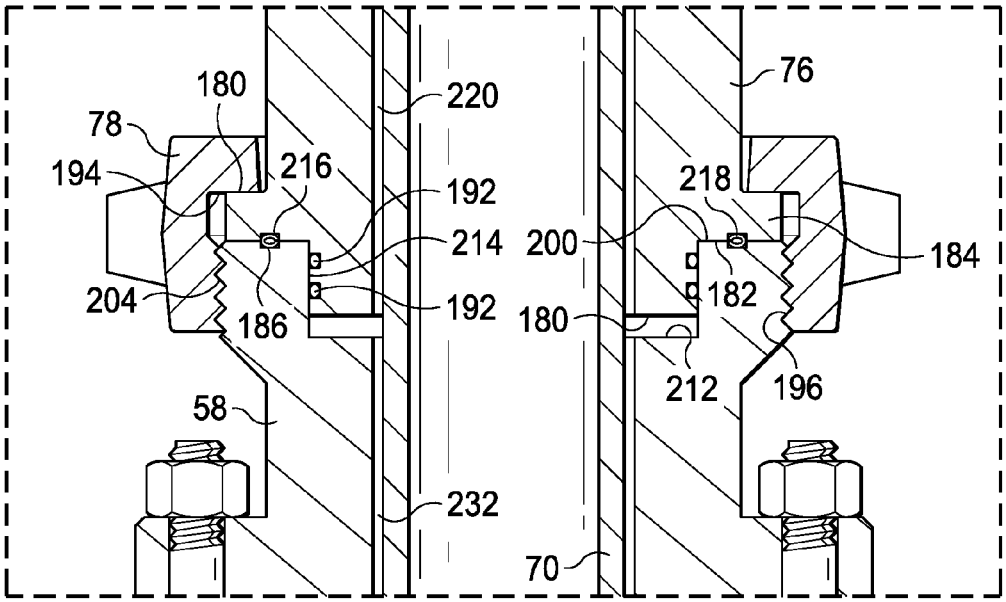
FIG. 7 is an enlarged view of a portion of FIG. 6C, illustrating the anchor assembly connected to, and sealingly engaged with, the adapter, according to an exemplary embodiment.

Still referring to FIG. 6C, as the hydraulic cylinder 24, the valve stack 26, the lock assembly 54, and the anchor assembly 56 continue to be lowered in the axial direction 224, the base member 76 of the anchor assembly 56 is placed into abutment with the adapter 58. Specifically, as shown in FIG. 7, the end face 180 of the base member 76 abuts, or nearly abuts, the internal annular shoulder 212 of the adapter 58. In this position, the end face 180 is located axially adjacent the internal annular shoulder 212. Further, the annular portion 214 of the adapter 58 is sealingly engaged by the annular seals 192 of the base member 76. Further still, the external annular shoulder 182 of the base member 76 abuts the end face 200 of the adapter 58. As a result, the resilient metal seal 218 is crushed between the annular groove 216 in the end face 200 of the adapter 58 and the annular groove 186 in the external annular shoulder 182 of the base member 76. In this manner, the resilient metal seal 218, along with the annular seals 192, prevents, or at least obstructs, a flow of fluid within the respective internal passages 58*e* and 76*e* of the adapter 58 and the base member 76 from escaping to the atmosphere. The base member 76 is secured in relation to the adapter 58 by threadably engaging the internal threads 196 of the threaded wing nut 78 with the external threads 204 of the adapter 58, such that the internal shoulder 194 of the threaded wing nut 78 abuts the external annular shoulder 178 of the base member 76. The annular foot 184 of the base member 76 is thus trapped between the internal shoulder 194 of the threaded wing nut 78 and the end face 200 of the adapter 58. In several exemplary embodiments, the threaded engagement of the internal threads 196 with the external threads 204 causes the resilient metal seal 218 to be crushed between the respective annular grooves 186 and 216 of the base member 76 and the adapter 58.

Figure 6D:
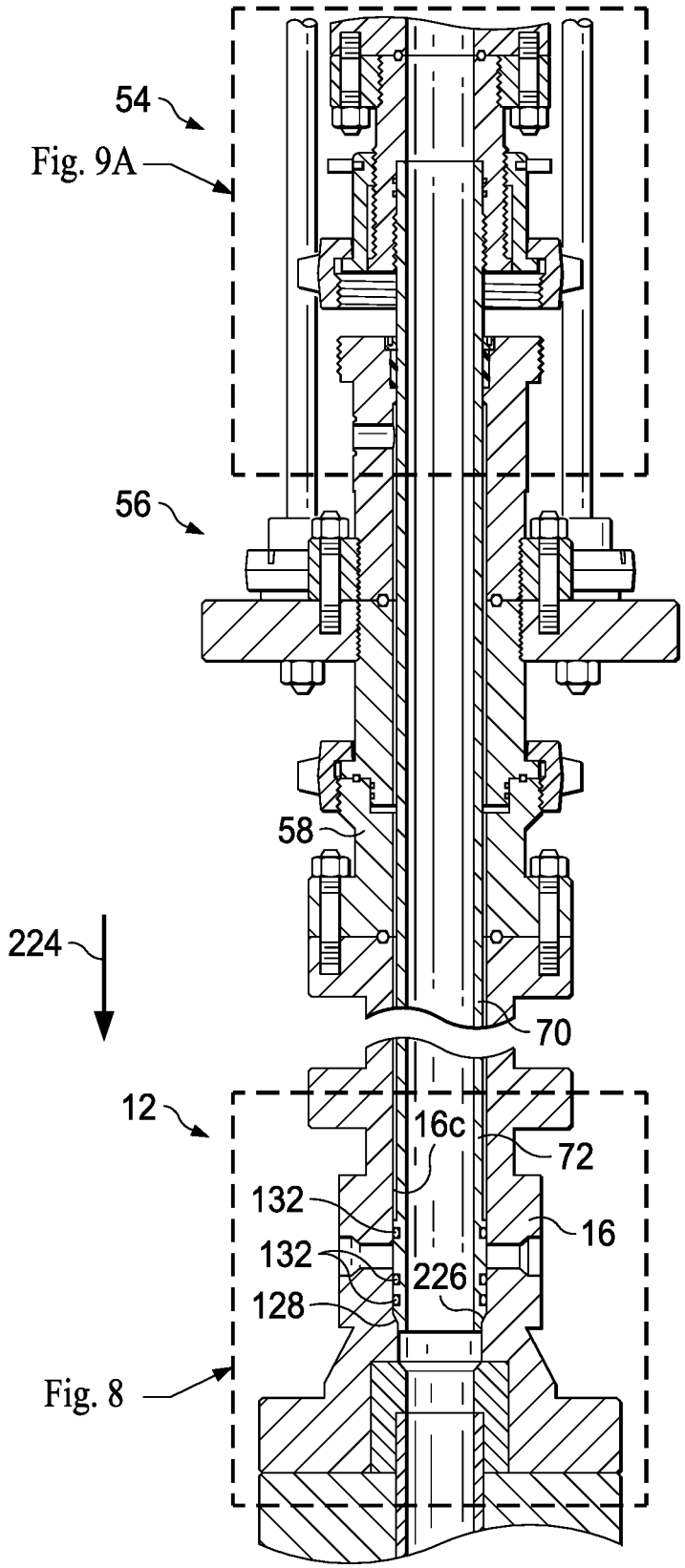
FIG. 6D is a cross-sectional view of the wellhead isolation tool of FIGS. 1-5 and 6A-6C, as the lock assembly is lowered further in relation to the anchor assembly, the adapter, and the wellhead, according to an exemplary embodiment.
Figure 8:
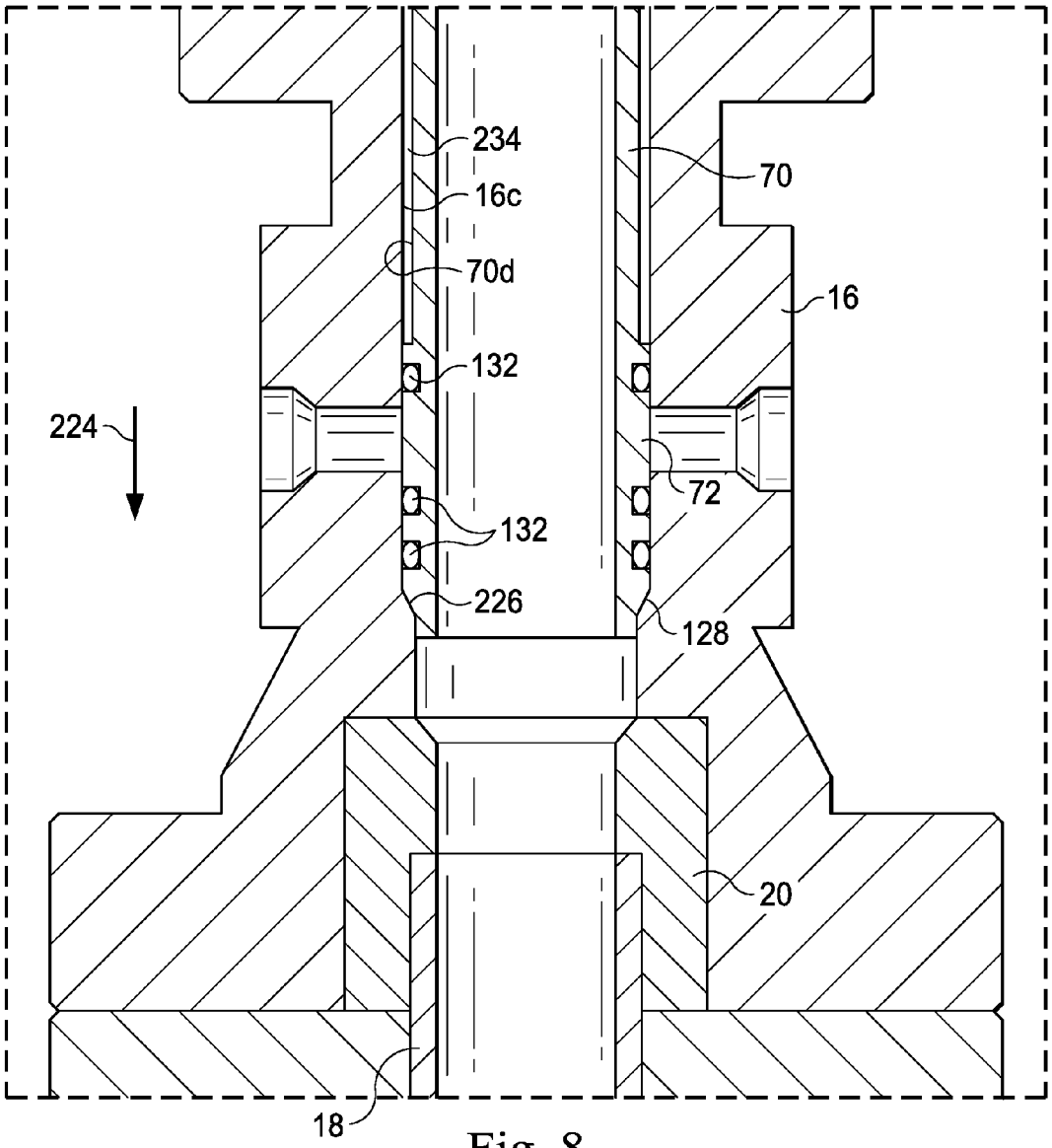
FIG. 8 is an enlarged view of a portion of FIG. 6D, illustrating a portion of the mandrel sealed within the wellhead, according to an exemplary embodiment.

Referring now to FIG. 6D, once the base member 76 is secured to the adapter 58 (as described above in relation to FIGS. 6C and 7), the hydraulic cylinder 24 is actuated to displace the valve stack 26 and the lock assembly 54 in the axial direction 224, relative to the anchor assembly 56. As a result, the mandrel 70 is displaced in the axial direction 224 relative to the anchor assembly 56, the adapter 58, and the wellhead 12. Moreover, as shown in FIG. 8, the annular seals 132 of the packoff assembly 72 are displaced in the axial direction 224, relative to the interior portion 16*c* of the tubing spool 16, until the external annular shoulder 128 of the packoff assembly 72 abuts the internal annular shoulder 226 of the tubing spool 16. In this position, the annular seals 132 of the packoff assembly 72 are sealingly engaged with the interior portion 16*c* of the tubing spool 16, at a location above the bit guide 20 and the casing string 18. Further, an annular space 234 is defined between the exterior portion 70*d* of the mandrel 70 and the interior portion 16*c* of the tubing spool 16. The annular space 234 is in fluid communication with the annular spaces 232 and 220, respectively. In this position, the annular seals 132 of the packoff assembly 72 are operably to prevent, or at least obstruct, a flow of fluid from the casing string 18 to the annular spaces 220, 232, and 234, respectively.

Figure 9A:
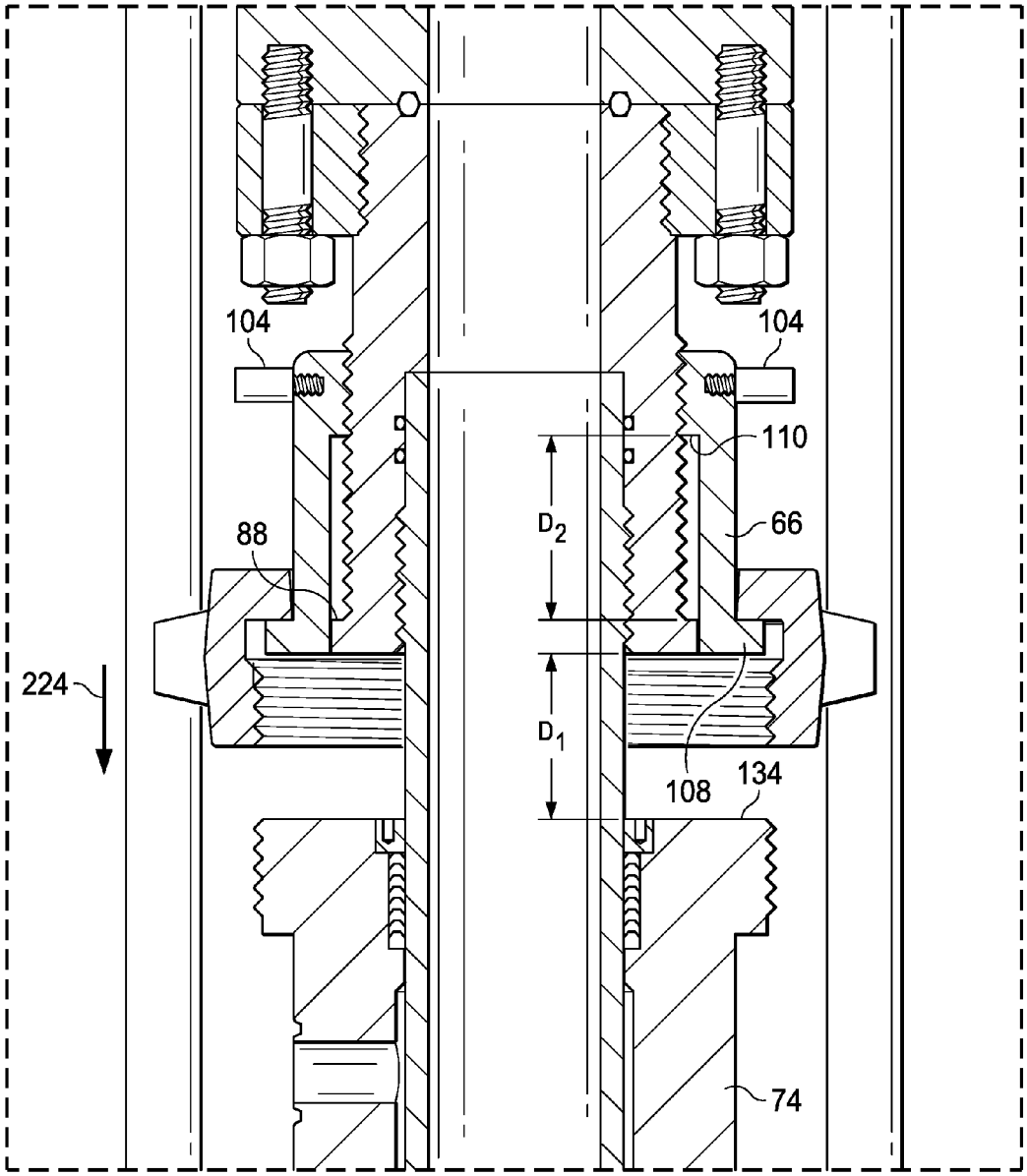
FIG. 9A is an enlarged view of another portion of FIG. 6D, illustrating the landing sleeve and threaded wing nut of the lock assembly in an initial configuration, according to an exemplary embodiment.
Figure 9B:
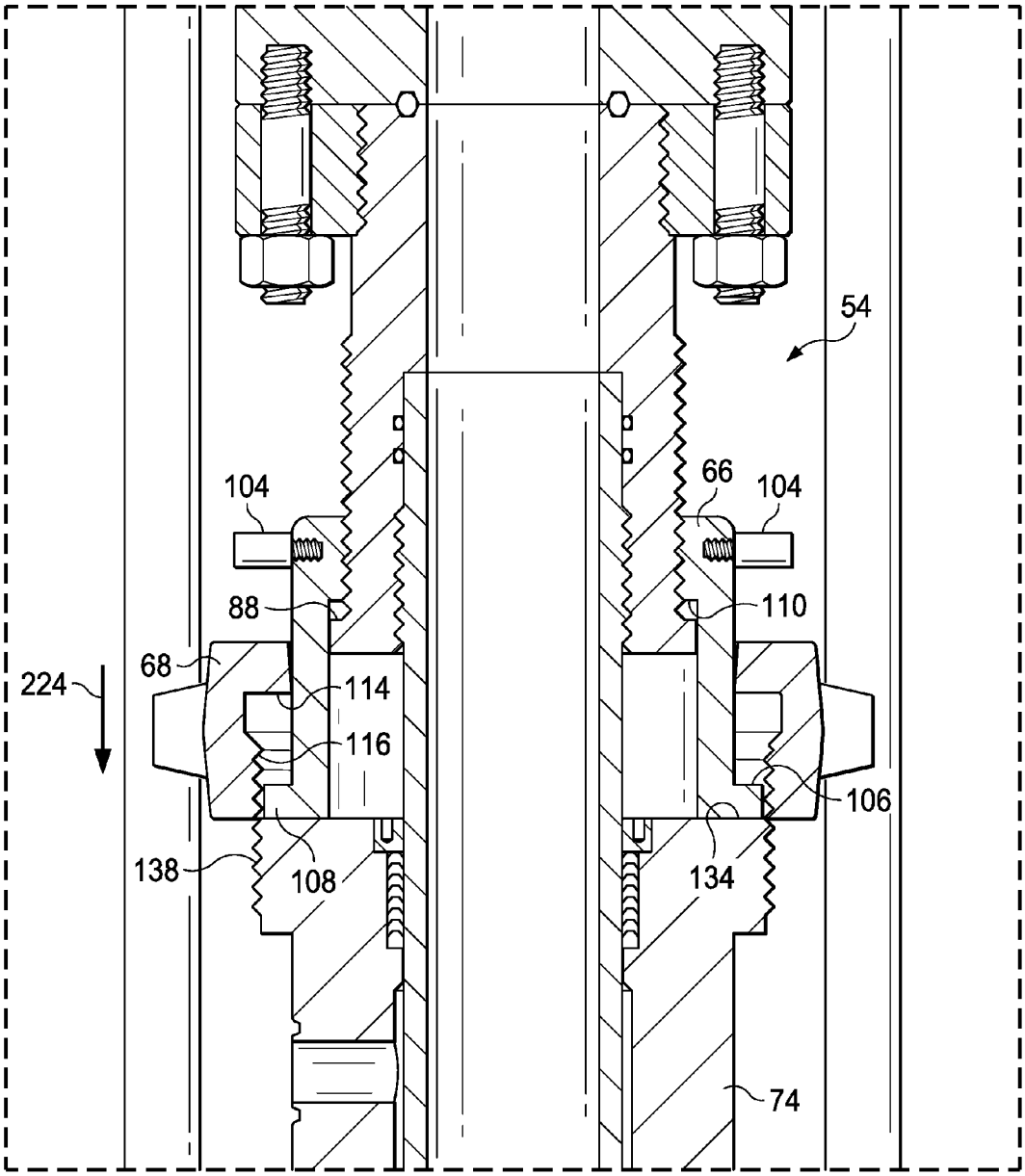
FIG. 9B is a detailed view of the lock assembly of FIG. 9A, the landing sleeve being relocated to engage the anchor assembly, according to an exemplary embodiment.
Figure 9C:
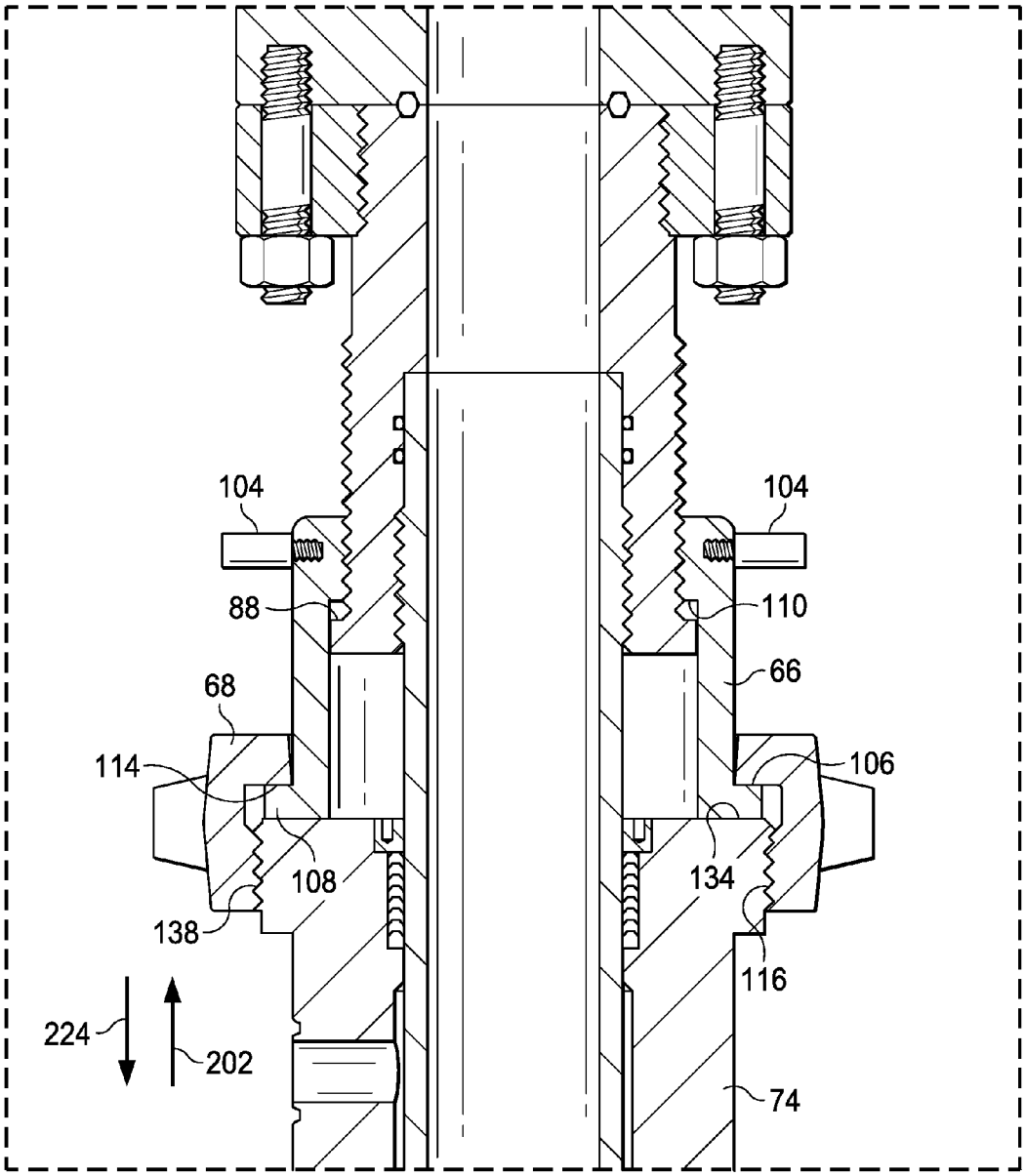
FIG. 9C is a detailed view of the lock assembly of FIG. 9B, the threaded wing nut being threadably connected to the anchor assembly, according to an exemplary embodiment.

In an exemplary embodiment, as illustrated in FIGS. 9A-9C, once the external annular shoulder 128 of the packoff assembly 72 has been lowered into abutment with the internal annular shoulder 226 of the tubing spool 16 (as discussed above in relation to FIGS. 6D and 8), the lock assembly 54 is utilized to lock the mandrel 70 and the packoff assembly 72 in position relative to the wellhead 12.

More particularly, as shown in FIG. 9A, a landing distance $D_1$ is initially defined between the external annular foot 108 of the landing sleeve 66 and the end face 134 of the support member 74. Further, a range of adjustment $D_2$ is defined between the internal annular shoulder 110 of the landing sleeve 66 and the external annular shoulder 88 of the mandrel head 64. While maintaining a sufficient level of hydraulic pressure within the hydraulic cylinder 24 (visible in FIG. 1) to urge the packoff assembly 72 into abutment with the internal annular shoulder 226 of the tubing spool 16, an external force is applied, via the handles 104, in order to rotate the landing sleeve 66. In this manner, the landing sleeve 66 is threadably advanced in the axial direction 224 and towards the support member 74 until the external annular foot 108 of the landing sleeve 66 abuts the end face 134 of the support member 74, as shown in FIG. 9B. The engagement of the landing sleeve 66 with the support member 74 provides support against any force applied to the lock assembly 54 in the direction 224. Specifically, any force applied to the mandrel head 64 and/or the landing sleeve 66 in the direction 224 is borne by the anchor assembly 56 and, consequently, the adapter 58 and the wellhead 12. Accordingly, any force applied to the mandrel head 64 and/or the landing sleeve 66 in the direction 224 is not transferred to the mandrel 70 or the packoff assembly 72. The lock assembly 54 is thus capable of protecting the mandrel 70 and the packoff assembly 72 by supporting the weight of the valve stack 26, the hydraulic cylinder 24, a variety of other wellbore cementing, acidizing, fracturing, and/or gravel packing equipment, and/or other well-site equipment.

Once the external annular foot 108 has been landed on the support member 74 (as discussed above in relation to FIG. 9B), an external force is applied to rotate the threaded wing nut 68, thereby threadably engaging the internal threads 116 of the threaded wing nut 68 with the external threads 138 of the support member 74. The threaded wing nut 68 is threadably advanced in the direction 224 until the internal annular shoulder 114 of the threaded wing nut 68 abuts the external annular shoulder 106 of the landing sleeve 66, as shown in FIG. 9C. In this manner, the annular foot 108 of the landing sleeve 66 is trapped between the internal annular shoulder 114 of the threaded wing nut 68 and the end face 134 of the support member 74. As a result, the threaded wing nut 68 secures the landing sleeve 66 to the locking member 74, thereby maintaining the packoff assembly 72 in sealing engagement with the interior portion 16*c* of the tubing spool 16. Furthermore, the engagement of the internal annular shoulder 114 of the threaded wing nut 68 with the external annular shoulder 106 of the landing sleeve 66 provides support against any external force applied to the lock assembly 54 in the direction 202. Specifically, any force applied to the mandrel head 64 and/or the landing sleeve 66 in the direction 202 is borne by the anchor assembly 56 and, consequently, the adapter 58 and the wellhead 12. Accordingly, any force applied to the mandrel head 64 and/or the landing sleeve 66 in the direction 202 is not transferred to the mandrel 70 or the packoff assembly 72. The lock assembly 54 is thus capable of protecting the mandrel 70 and the packoff assembly 72 from any force in the direction 202 that may cause leakage, blow by, and/or "lift-off" of the packoff assembly, such as, for example, excessive fluid pressure within the casing string 18, the tubing head 16, and/or the mandrel 70.

In order for the external annular foot 108 to properly land on the end face 134 of the support member 74, the landing distance $D_1$ must be less than, or equal to, the range of adjustment $D_2$. In several exemplary embodiments, in order to ensure that the landing distance $D_1$ is less than, or equal to, the range of adjustment $D_2$, the overall length of the mandrel 70 is adjusted via the addition or removal of one or more mandrel extension sections (not shown). Accordingly, the lock assembly 54 is compatible for use with a variety of different wellheads, including, but not limited to, the wellhead 12.

Once the landing sleeve 66 has been secured to the locking member 74 via the threaded wing nut 68 (as discussed above in relation to FIG. 9C), the stay rods 62 and hydraulic cylinder 24 are removed from the wellhead isolation assembly 10 so that the valve stack 26 and the wellhead isolation tool 28 may be used to conduct one or more oil or gas wellbore operations, such as, for example, cementing, acidizing, fracturing, and/or gravel packing of a subterranean wellbore. In several exemplary embodiments, use of the wellhead isolation tool 28 as described herein in connection with the above-described wellbore operations prevents, or at least reduces, any tendency of the packoff assembly 72, including the annular seals 132, to "lift-off" from the internal annular shoulder 226 and/or the interior portion 16*c* of the tubing spool 16. In this manner, the wellhead isolation tool 28 prevents the operating fluid from leaking or blowing by the packoff assembly 72, including the annular seals 132, and into the wellhead 12. In several exemplary embodiments, use of the wellhead isolation tool 28 as described herein protects the packoff assembly 72, including the annular seals 132, from damage by supporting against external forces applied to the mandrel 70 along the longitudinal axis thereof, in both of the axial directions 202 and 224, respectively.

In several exemplary embodiments, the lock assembly 54 operates to prevent, or at least reduce, the transfer of any force from the mandrel head 64 or the landing sleeve 66 to the mandrel 70 and, consequently, the packoff assembly 72.

In several exemplary embodiments, the lock assembly 54 operates to prevent, or at least reduce, the transfer of any axial force from the mandrel head 64 or the landing sleeve 66 to the mandrel 70 and, consequently, the packoff assembly 72.

In several exemplary embodiments, the lock assembly 54 isolates the mandrel 70 and the packoff assembly 72 from any external forces that are applied to the mandrel head 64 or the locking sleeve 66.

In several exemplary embodiments, the lock assembly 54 operates to lock the mandrel 70, including the packoff assembly 72, down into position within the wellhead 12, while, at the same time, supporting the weight of the valve stack 26, the hydraulic cylinder 24, a variety of other wellbore fracturing and gravel packing equipment, and/or other well-site equipment.

The anchor assembly 56 and the adapter 58 have been described herein as part of the wellhead isolation assembly 10. However, in several exemplary embodiments, instead of, or in addition to, being part of the wellhead isolation assembly 10, the anchor assembly 56 is, includes, or is part of, a wellsite connector that may be used to connect various wellsite components within a number of wellsite systems, such as, for example, a pump system, a manifold system, a lubricator system, another wellsite system, etc. Further, in several exemplary embodiments, instead of, or in addition to, being part of the wellhead isolation assembly 10, the combination of the anchor assembly 56 and the adapter 58 is, includes, or is part of, another wellsite connector that may be used to connect various wellsite components within a number of wellsite systems, such as, for example, a pump system, a manifold system, a lubricator system, another wellsite system, etc. Further still, in several exemplary embodiments, instead of, or in addition to, being part of the wellhead isolation assembly 10, the combination of the base member 76 and the adapter 58 is, includes, or is part of, yet another wellsite connector that may be used to connect various wellsite components within a number of wellsite systems, such as, for example, a pump system, a manifold system, a lubricator system, another wellsite system, etc.

Moreover, in several exemplary embodiments, instead of, or in addition to, being part of the wellhead isolation assembly 10, one or more components of the anchor assembly 56 form, include, or are part of, a wellsite connector that may be used to connect various wellsite components within a number of wellsite systems, such as, for example, a pump system, a manifold system, a lubricator system, another wellsite system, etc. Further, in several exemplary embodiments, instead of, or in addition to, being part of the wellhead isolation assembly 10, the combination of one or more components of the anchor assembly 56 and one or more components of the adapter 58 is, includes, or is part of, another wellsite connector that may be used to connect various wellsite components within a number of wellsite systems, such as, for example, a pump system, a manifold system, a lubricator system, another wellsite system, etc. Further still, in several exemplary embodiments, instead of, or in addition to, being part of the wellhead isolation assembly 10, the combination of one or more components of the base member 76 and one or more components of the adapter 58 is, includes, or is part of, yet another wellsite connector that may be used to connect various wellsite components within a number of wellsite systems, such as, for example, a pump system, a manifold system, a lubricator system, another wellsite system, etc.

In several exemplary embodiments, as illustrated in FIGS. 1-7 and 9A-9C, each of the fasteners 86, 156, and 210 includes a threaded stud and a nut threadably engaged therewith. In several exemplary embodiments, instead of a threaded stud and a nut threadably engaged therewith, one or more of the fasteners 86, 156, and 210 includes a bolt, the bolt including a bolt head and an axial portion extending therefrom and through a corresponding one of the through-holes 84, 154, or 208, at least the distal end portion of the axial portion including external threads that threadably engage corresponding internal threads of the valve 50, corresponding ones of the threaded-holes 176, or corresponding internal threads formed in the uppermost flange 22 of the wellhead 12. In several exemplary embodiments, one or more of the through-holes 84, 154, and 208 are threaded-holes which, in several exemplary embodiments, may be threadably engaged with corresponding ones of the fasteners 86, 156, and 210, respectively. In several exemplary embodiments, the threaded-holes 176 are through-holes, each of which extends through the base plate 60. In several exemplary embodiments, the threaded-holes 176 are through-holes, each of which extends through the base plate 60, and each of the fasteners 156 extends through the flange 150 and the base plate 60. In several exemplary embodiments, the threaded-holes 176 are through-holes, each of which extends through the base plate 60, and each of the fasteners 156 extends through the flange 150 and the base plate 60, and each of the fasteners 156 further includes another nut that is threadably engaged with the threaded stud and that engages the flange 150 on the side thereof axially opposing the flange 150. In several exemplary embodiments, instead of, or in addition to, a threaded stud and a nut threadably engaged therewith, one or more of the fasteners 86, 156, and 210 includes one or more other components such as, for example, another nut threadably engaged with the threaded stud.

The present disclosure introduces a wellsite connector apparatus, including an adapter including a first end face having a first annular groove formed therein, a first annular shoulder, and a first annular portion extending axially between the first end face and the first annular shoulder; a first member adapted to be connected to the adapter, the first member including a second end face, a second annular shoulder having a second annular groove formed therein, and a second annular portion extending axially between the second end face and the second annular shoulder; and a resilient metal seal adapted to be crushed between the first and second annular grooves when the first member is connected to the adapter; wherein, when the first member is connected to the adapter, the first end face and the first annular shoulder are axially adjacent the second end face and the second annular shoulder, respectively, and the first and second annular portions are radially adjacent one another. In an exemplary embodiment, one of the first and second annular portions includes one or more annular grooves and the other of the first and second annular portions includes an annular sealing surface; wherein the wellsite connector apparatus further comprises one or more annular seals extending within the one or more annular grooves, respectively; and, when the first and second annular portions are radially adjacent one another, the one or more annular seals sealingly engage the annular sealing surface. In an exemplary embodiment, the resilient metal seal is a metal C-ring seal. In an exemplary embodiment, the wellsite connector apparatus further includes a connector including internal threads and an internal annular shoulder; wherein one of the adapter and the first member includes external threads and the other of the adapter and the first member includes an external annular shoulder; wherein, when the first member is connected to the adapter, the internal threads of the connector threadably engage the external threads so that the internal annular shoulder of the connector engages the external annular shoulder to crush the resilient metal seal between the first and second annular grooves. In an exemplary embodiment, the wellsite connector apparatus further includes a base plate connected to the first member via a first weld-less connection and a flange connected to a second member via a second weld-less connection, the base plate and the flange being connected to each other via a third weld-less connection; wherein the first and second members define first and second fluid passageways, respectively; and wherein the first, second, and third weld-less connections are configured so that the first and second fluid passageways are in fluid communication with each other. In an exemplary embodiment, the first member includes first external threads and the base plate includes first internal threads that are threadably engaged with the first external threads to effect the first weld-less connection; and the second member defines second external threads and the flange defines second internal threads that are threadably engaged with the second external threads to effect the second weld-less connection. In an exemplary embodiment, a plurality of threaded-holes are formed in one of the base plate and the flange and distributed circumferentially thereabout; a plurality of through-holes are formed through the other of the base plate and the flange and distributed circumferentially thereabout, the through-holes being aligned with the threaded-holes; and a plurality of fasteners extend through the through-holes and threadably engage the threaded-holes to effect the third weld-less connection.

The present disclosure also introduces a wellsite connector apparatus, including first and second members defining first and second fluid passageways, respectively, the first and second members being adapted to be connected to first and second wellsite components, respectively; a base plate connected to the first member via a first weld-less connection; and a flange connected to the second member via a second weld-less connection; wherein the base plate and the flange are connected to each other via a third weld-less connection; and wherein the first, second, and third weld-less connections are configured so that: the first and second fluid passageways are co-axial; and the first and second wellsite components are in fluid communication with each other, via at least the first and second fluid passageways, when the first and second members are connected to the first and second wellsite components, respectively. In an exemplary embodiment, the first member includes first external threads and the base plate includes first internal threads that are threadably engaged with the first external threads to effect the first weld-less connection; and the second member defines second external threads and the flange defines second internal threads that are threadably engaged with the second external threads to effect the second weld-less connection. In an exemplary embodiment, a plurality of threaded-holes are formed in one of the base plate and the flange and distributed circumferentially thereabout; a plurality of through-holes are formed through the other of the base plate and the flange and distributed circumferentially thereabout, the through-holes being aligned with the threaded-holes; and a plurality of fasteners extend through the through-holes and threadably engage the threaded-holes to effect the third weld-less connection. In an exemplary embodiment, the first member includes a first annular shoulder having a first annular groove formed therein; and the wellsite connector apparatus further includes an adapter to which the first wellsite component is adapted to be connected, the adapter being connected to the first member and comprising a first end face having a second annular groove formed therein; and a resilient metal seal crushed between the first and second annular grooves. In an exemplary embodiment, the wellsite connector apparatus further includes a connector including internal threads and an internal annular shoulder; wherein one of the adapter and the first member includes external threads and the other of the adapter and the first member includes an external annular shoulder; and wherein the internal threads of the connector threadably engage the external threads and the internal annular shoulder of the connector engages the external annular shoulder so that the resilient metal seal is crushed between the first and second annular grooves. In an exemplary embodiment, the first member further includes a second end face and a first annular portion extending axially between the second end face and the first annular shoulder; the adapter further includes a second annular shoulder and a second annular portion extending axially between the first end face and the second annular shoulder; and the first and second annular portions are radially adjacent one another. In an exemplary embodiment, one of the first and second annular portions includes one or more annular grooves and the other of the first and second annular portions includes an annular sealing surface; the wellsite connector apparatus further includes one or more annular seals extending within the one or more annular grooves, respectively; and, when the first and second annular portions are radially adjacent one another, the one or more annular seals sealingly engage the annular sealing surface.

The present disclosure also introduces a method of assembling a wellsite connector apparatus, the method including connecting a base plate to a first member via a first weld-less connection, the first member defining a first fluid passageway and being adapted to be connected to a first wellsite component; connecting a flange to a second member via a second weld-less connection, the second member defining a second fluid passageway and being adapted to be connected to a second wellsite component; and connecting the flange to the base plate via a third weld-less connection; wherein the first, second, and third weld-less connections are configured so that: the first and second fluid passageways are co-axial; and the first and second wellsite components are in fluid communication with each other, via at least the first and second fluid passageways, when the first and second members are connected to the first and second wellsite components, respectively. In an exemplary embodiment, connecting the base plate to the first member via the first weld-less connection includes threadably engaging first internal threads of the base plate with first external threads of the first member; and connecting the flange to the second member via the second weld-less connection includes threadably engaging second internal threads of the flange with second external threads of the second member. In an exemplary embodiment, a plurality of threaded-holes are formed in one of the base plate and the flange and distributed circumferentially thereabout; a plurality of through-holes are formed through the other of the base plate and the flange and distributed circumferentially thereabout; and connecting the flange to the base plate via the third weld-less connection includes threadably engaging a plurality of fasteners with respective ones of the threaded-holes, aligning the through-holes with the threaded-holes, and inserting the plurality of fasteners through respective ones of the through-holes. In an exemplary embodiment, the first member includes a first annular shoulder having a first annular groove formed therein; and the method further includes: providing an adapter comprising a first end face having a second annular groove formed therein; and connecting the first member to the adapter so that a resilient metal seal is crushed between the first and second annular grooves. In an exemplary embodiment, connecting the first member to the adapter includes threadably engaging internal threads of a connector with external threads of one of the adapter and the first member; and engaging an internal annular shoulder of the connecter with an external annular shoulder of the other of the adapter and the first member to crush the resilient metal seal between the first and second annular grooves. In an exemplary embodiment, the first member further includes a second end face and a first annular portion extending axially between the second end face and the first annular shoulder; the adapter further includes a second annular shoulder and a second annular portion extending axially between the first end face and the second annular shoulder; and, when the first member is connected to the adapter, the first end face and the first annular shoulder are axially adjacent the second end face and the second annular shoulder, respectively, and the first and second annular portions are radially adjacent one another.

It is understood that variations may be made in the foregoing without departing from the scope of the present disclosure.

In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, and/or combined, at least in part, with one or more of the other elements and teachings of the various illustrative embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes, and/or procedures may be merged into one or more steps, processes and/or procedures.

In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112, paragraph 6 for any limitations of any of the claims herein, except for those in which the claim expressly uses the word "means" together with an associated function.

What is claimed is:

1. An isolation tool for protecting a wellhead to which a casing string is operably coupled, the isolation tool comprising:

an anchor assembly adapted to be connected to the wellhead;

a mandrel adapted to be displaced in a first axial direction, relative to the anchor assembly and the wellhead, to sealingly engage an interior portion of at least one of the wellhead and the casing string; and a lock assembly comprising:

a landing sleeve adapted to be displaced in a second axial direction, relative to the mandrel, the anchor assembly, and the wellhead, to engage the anchor assembly; and a connector adapted to secure the landing sleeve to the anchor assembly when the mandrel sealingly engages the interior portion of the wellhead and/or the casing string, and the landing sleeve engages the anchor assembly;

wherein the first axial direction is the same as the second axial direction.

2. The isolation tool of claim 1, wherein, to protect the wellhead, the sealing engagement of the mandrel with the interior portion of the wellhead and/or the casing string fluidically isolates the casing string from at least a portion of the wellhead.

3. The isolation tool of claim 1, wherein, when the connector secures the landing sleeve to the anchor assembly, the lock assembly prevents, or at least reduces, the transfer of any axial force from the mandrel to the interior portion of the wellhead and/or the casing string.

4. The isolation tool of claim 1, wherein the anchor assembly comprises:

a first member adapted to be connected to the wellhead;

a base plate connected to the first member; and a second member to which the connector is adapted to be secured, the second member being connected to the first member via a weld-less connection with the base plate.

5. The isolation tool of claim 4, further comprising an actuator adapted to be connected to the base plate and to displace the mandrel in the first axial direction to sealingly engage the mandrel with the interior portion of the wellhead and/or the casing string.

6. The isolation tool of claim 1, wherein the anchor assembly comprises an annular shoulder having a first annular groove formed therein; and wherein the isolation tool further comprises:

an adapter to which the anchor assembly is adapted to be connected, the adapter being adapted to be connected to the wellhead and comprising an end face having a second annular groove formed therein; and a resilient metal seal adapted to be crushed between the first and second annular grooves when the anchor assembly is connected to the adapter.

7. A method of protecting a wellhead to which a casing string is operably coupled, the method comprising:

connecting an anchor assembly to the wellhead;

positioning a mandrel within the wellhead;

displacing the mandrel in a first axial direction, relative to the anchor assembly and the wellhead, to sealingly engage the mandrel with an interior portion of at least one of the wellhead and the casing string;

displacing a landing sleeve in a second axial direction, relative to the mandrel, the anchor assembly, and the wellhead, to engage the anchor assembly; and securing the landing sleeve to the anchor assembly to maintain the sealing engagement of the mandrel with the interior portion of the wellhead and/or the casing string;

wherein the first axial direction is the same as the second axial direction.

8. The method of claim 7, wherein, to protect the wellhead, the sealing engagement of the mandrel with the interior portion of the wellhead and/or the casing string fluidically isolates the casing string from at least a portion of the wellhead.

9. The method of claim 7, wherein, when the landing sleeve is secured to the anchor assembly, the transfer of any axial force from the mandrel to the interior portion of the wellhead and/or the casing string is either prevented or at least reduced.

10. The method of claim 7, wherein displacing the mandrel in the first axial direction comprises: connecting an actuator to the anchor assembly; and displacing the mandrel, using the actuator and relative to the anchor assembly and the wellhead, to sealingly engage the mandrel with the interior portion of the wellhead and/or the casing string.

11. The method of claim 10, wherein the anchor assembly comprises:

a first member adapted to be connected to the wellhead;

a base plate connected to the first member and to which the actuator is adapted to be connected; and a second member connected to the first member via a weld-less connection with the base plate; and wherein securing the landing sleeve to the anchor assembly comprises securing the landing sleeve to the second member.

12. The method of claim 7, wherein the anchor assembly comprises an annular shoulder having a first annular groove formed therein; and wherein connecting the anchor assembly to the wellhead comprises:

connecting an adapter to the wellhead, the adapter comprising an end face having a second annular groove formed therein; and connecting the anchor assembly to the adapter so that a resilient metal seal is crushed between the first and second annular grooves.

13. An isolation tool adapted to be connected to a wellhead to which a casing string is operably coupled, the isolation tool comprising:

an anchor assembly adapted to be connected to the wellhead, the anchor assembly defining an internal passage and comprising an internal annular seal extending about the internal passage;

a mandrel adapted to extend through the internal passage of the anchor assembly so that the internal annular seal sealingly engages the mandrel, and adapted to be displaced, relative to the internal annular seal, to sealingly engage an interior portion of at least one of the wellhead and the casing string; and a lock assembly comprising:

a landing sleeve adapted to be displaced, relative to the internal annular seal, to engage the anchor assembly;

wherein, when the internal annular seal sealingly engages the mandrel, an annular space is defined within the internal passage between the mandrel and the anchor assembly; and wherein the sealing engagement of the internal annular seal with the mandrel prevents, or at least reduces, fluid communication between the annular space and atmosphere.

14. The isolation tool of claim 13, wherein the sealing engagement of the internal annular seal with the mandrel prevents, or at least reduces, fluid communication between the annular space and atmosphere so that the wellhead may be pressurized when the mandrel extends through the internal passage of the anchor assembly.

15. The isolation tool of claim 13, wherein the anchor assembly comprises:

a first member adapted to be connected to the wellhead;

a base plate connected to the first member; and a second member to which the landing sleeve is adapted to be secured, the second member being connected to the first member via a weld-less connection with the base plate.

16. The isolation tool of claim 15, further comprising an actuator adapted to be connected to the base plate and to displace the mandrel to sealingly engage the mandrel with the interior portion of the wellhead and/or the casing string.

17. The isolation tool of claim 13, wherein the anchor assembly comprises an annular shoulder having a first annular groove formed therein; and wherein the isolation tool further comprises:

an adapter to which the anchor assembly is adapted to be connected, the adapter being adapted to be connected to the wellhead and comprising an end face having a second annular groove formed therein; and a resilient metal seal adapted to be crushed between the first and second annular grooves when the anchor assembly is connected to the adapter.

18. A method of protecting a wellhead to which a casing string is operably coupled, the method comprising:

connecting an anchor assembly to the wellhead, the anchor assembly defining an internal passage and comprising an internal annular seal extending about the internal passage;

sealingly engaging a mandrel with the internal annular seal;

displacing the mandrel, relative to the internal annular seal, to sealingly engage the mandrel with an interior portion of at least one of the wellhead and the casing string;

displacing a landing sleeve, relative to the internal annular seal, to engage the anchor assembly; and securing the landing sleeve to the anchor assembly to maintain the sealing engagement of the mandrel with the interior portion of the wellhead and/or the casing string;

wherein, when the mandrel is sealingly engaged with the internal annular seal, an annular space is defined within the internal passage between the mandrel and the anchor assembly; and wherein the sealing engagement of the internal annular seal with the mandrel prevents, or at least reduces, fluid communication between the annular space and atmosphere.

19. The method of claim 18, wherein the sealing engagement of the internal annular seal with the mandrel prevents, or at least reduces, fluid communication between the annular space and atmosphere so that the wellhead may be pressurized when the mandrel extends through the internal passage of the anchor assembly.

20. The method of claim 18, wherein the anchor assembly comprises:

a first member adapted to be connected to the wellhead;

a base plate connected to the first member; and a second member connected to the first member via a weld-less connection with the base plate; and wherein securing the landing sleeve to the anchor assembly comprises securing the landing sleeve to the second member.

21. The method of claim 20, wherein displacing the mandrel comprises:

connecting an actuator to the base plate; and displacing the mandrel, using the actuator and relative to the anchor assembly and the wellhead, to sealingly engage the mandrel with the interior portion of the wellhead and/or the casing string.

22. The method of claim 18, wherein the anchor assembly comprises an annular shoulder having a first annular groove formed therein; and wherein connecting the anchor assembly to the wellhead comprises:

connecting an adapter to the wellhead, the adapter comprising an end face having a second annular groove formed therein; and connecting the anchor assembly to the adapter so that a resilient metal seal is crushed between the first and second annular grooves.

23. An isolation tool for protecting a wellhead to which a casing string is operably coupled, the isolation tool comprising:

an anchor assembly adapted to be connected to the wellhead;

a mandrel adapted to be displaced in a first axial direction by an actuator, such axial displacement being relative to the anchor assembly and the wellhead, to sealingly engage an interior portion of at least one of the wellhead and the casing string;

a mandrel head connected to the mandrel and axially displaceable together therewith;

a lock assembly:

comprising a connector adapted to secure the landing sleeve to the anchor assembly when the mandrel sealingly engages the interior portion of the wellhead and/or the casing string and the landing sleeve engages the anchor assembly, and threadably configured to secure the mandrel and mandrel head in position when the mandrel has sealingly engaged an interior portion of at least one of the wellhead and the casing string;

wherein the first axial direction is the same as the second axial direction.

24. The isolation tool of claim 23 wherein the actuator comprises a hydraulic cylinder.

25. The isolation tool of claim 24 wherein:

the anchor assembly comprises a base plate;

the hydraulic cylinder comprises a support plate; and a plurality of stay rods are connected between the base plate and the support plate.

26. The isolation tool of claim 23 wherein the mandrel comprises a packoff assembly comprising:

an external annular tapered shoulder; and a plurality of annular grooves with an elastomeric sealing element disposed within one or more such grooves.

27. The isolation tool of claim 23 wherein:

the anchor assembly comprises an annular shoulder having a first annular groove formed therein; and wherein the isolation tool further comprises:

an adapter to which the anchor assembly is adapted to be connected, the adapter being adapted to be connected to the wellhead and comprising an end face having a second annular groove formed therein; and a resilient metal seal adapted to be crushed between the first and second annular grooves when the anchor assembly is connected to the adapter.

* * * * *